US008703373B2

(12) United States Patent
Iwasaki

(10) Patent No.: US 8,703,373 B2
(45) Date of Patent: Apr. 22, 2014

(54) ELECTROPHOTOGRAPHIC PHOTORECEPTOR, METHOD OF PRODUCING ELECTROPHOTOGRAPHIC PHOTORECEPTOR, IMAGE FORMING APPARATUS, AND PROCESS CARTRIDGE

(75) Inventor: Masahiro Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/358,903

(22) Filed: Jan. 26, 2012

(65) Prior Publication Data

US 2013/0065169 A1 Mar. 14, 2013

(30) Foreign Application Priority Data

Sep. 8, 2011 (JP) ..... 2011-196122

(51) Int. Cl.
*G03G 15/04* (2006.01)
*G03G 15/00* (2006.01)

(52) U.S. Cl.
USPC ..... 430/66; 430/58.35; 430/58.5; 430/59.7; 430/59.3; 399/111; 399/159

(58) Field of Classification Search
USPC ..... 430/66, 59.3, 58.7, 58.5, 58.35; 399/111, 159
See application file for complete search history.

(56) References Cited

U.S. PATENT DOCUMENTS

| | | | |
|---|---|---|---|
| 5,456,989 | A | 10/1995 | Nogami et al. |
| 2002/0119382 | A1 | 8/2002 | Nakata et al. |
| 2005/0181291 | A1 | 8/2005 | Kami et al. |
| 2007/0065741 | A1 * | 3/2007 | Iemura et al. ..... 430/60 |

FOREIGN PATENT DOCUMENTS

| | | |
|---|---|---|
| JP | A-62-251757 | 11/1987 |
| JP | A-06-250430 | 9/1994 |
| JP | A-07-146564 | 6/1995 |
| JP | A-2000-019749 | 1/2000 |
| JP | A-2000-066424 | 3/2000 |
| JP | A-2002-082469 | 3/2002 |
| JP | B2-3287678 | 6/2002 |
| JP | A-2005-234546 | 9/2005 |
| JP | A-2006-084711 | 3/2006 |
| JP | B2-4319553 | 8/2009 |

* cited by examiner

*Primary Examiner* — Thorl Chea

(74) *Attorney, Agent, or Firm* — Oliff PLC

(57) ABSTRACT

An electrophotographic photoreceptor includes a conductive substrate; and a photosensitive layer on the conductive substrate, wherein a layer having an outermost surface of the photoreceptor contains a polymer that is formed by polymerizing a crosslinkable charge transport material having an aromatic group and a —$CH_2OH$ group, and the layer having the outermost surface satisfies the following Formula (1):

$$(\text{Peak 2})/(\text{Peak 1}) \leq 0.05 \quad (1)$$

wherein Peak 1 represents a peak area of an absorption peak (from about 1550 $cm^{-1}$ to about 1650 $cm^{-1}$) of stretching vibration of an aromatic group, which is obtained when an infrared absorption spectrum of the layer having the outermost surface is measured, and Peak 2 represents a peak area of an absorption peak (from about 1670 $cm^{-1}$ to about 1710 $cm^{-1}$) of an aromatic aldehyde, which is obtained when the infrared absorption spectrum of the layer having the outermost surface is measured.

9 Claims, 4 Drawing Sheets

ELECTROPHOTOGRAPHIC PHOTORECEPTOR, METHOD OF PRODUCING ELECTROPHOTOGRAPHIC PHOTORECEPTOR, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2011-196122 filed Sep. 8, 2011.

BACKGROUND

1. Technical Field

The present invention relates to an electrophotographic photoreceptor, a method of producing the electrophotographic photoreceptor, an image forming apparatus, and a process cartridge.

2. Related Art

In an electrophotographic image forming apparatus, the surface of an electrophotographic photoreceptor is charged with a predetermined polarity and potential by a charging device, an electrostatic latent image is formed by selectively erasing the surface of the charged electrophotographic photoreceptor by image exposure, the latent image is then developed as a toner image by attaching a toner to the electrostatic latent image by using a developing unit, and the toner image is transferred to a transfer medium by a transfer unit so as to be discharged as a formed image.

SUMMARY

According to an aspect of the invention, there is provided an electrophotographic photoreceptor including a conductive substrate and a photosensitive layer on the conductive substrate, wherein a layer having an outermost surface of the photoreceptor contains a polymer that is formed by polymerizing a crosslinkable charge transport material having an aromatic group and a —$CH_2OH$ group, and the layer having the outermost surface satisfies the following Formula (1):

$$(\text{Peak 2})/(\text{Peak 1}) \leq 0.05 \quad (1)$$

wherein Peak 1 represents a peak area of an absorption peak (from about 1550 $cm^{-1}$ to about 1650 $cm^{-1}$) of stretching vibration of an aromatic group, which is obtained when an infrared absorption spectrum of the layer having the outermost surface is measured, and Peak 2 represents a peak area of an absorption peak (from about 1670 $cm^{-1}$ to about 1710 $cm^{-1}$) of aromatic aldehyde, which is obtained when the infrared absorption spectrum of the layer having the outermost surface is measured.

BRIEF DESCRIPTION OF THE DRAWINGS

Exemplary embodiments of the present invention will be described in detail based on the following figures, wherein.

DETAILED DESCRIPTION

Figure 1:
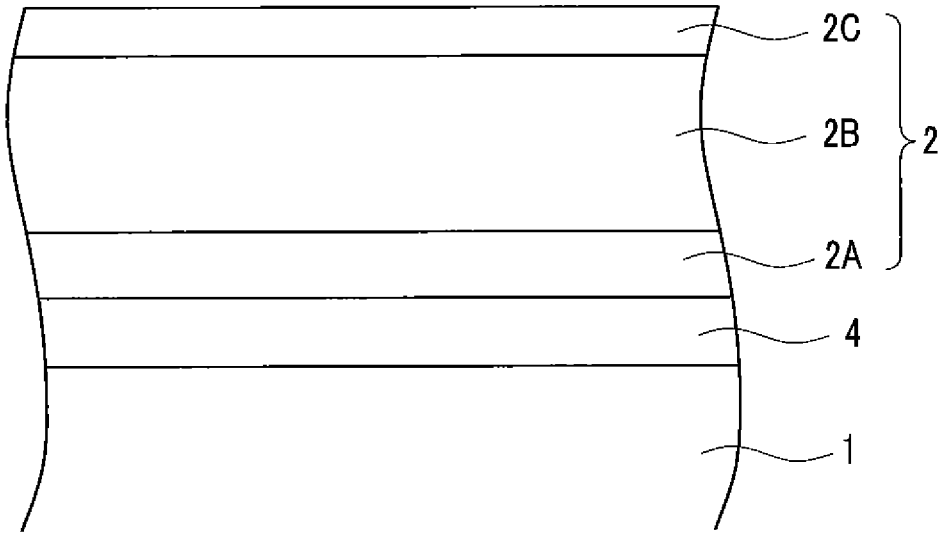
FIG. 1 is a schematic partial cross-sectional view showing an electrophotographic photoreceptor of a first embodiment used for the exemplary embodiment.

Hereinafter, the exemplary embodiment of the invention will be described in detail.

<Electrophotographic Photoreceptor>

The electrophotographic photoreceptor (hereinafter, simply referred to as a "photoreceptor" in some cases) according to the exemplary embodiment includes a conductive substrate and a photosensitive layer on the conductive substrate. A layer (hereinafter, simply referred to as "outermost surface layer" in some cases) having the outermost surface of the photoreceptor contains a polymer that is formed by polymerizing a crosslinkable charge transport material having an aromatic group and a —$CH_2OH$ group. When an infrared absorption spectrum of the layer having the outermost surface is measured, provided that a peak area of an absorption peak (from 1550 $cm^{-1}$ to 1650 $cm^{-1}$ or from about 1550 $cm^{-1}$ to about 1650 $cm^{-1}$) of stretching vibration of an aromatic group is (Peak 1), and that a peak area of an absorption peak (from 1670 $cm^{-1}$ to 1710 $cm^{-1}$ or from about 1670 $cm^{-1}$ to about 1710 $cm^{-1}$) of an aromatic aldehyde is (Peak 2), this layer satisfies the following Formula (1).

$$(\text{Peak 2})/(\text{Peak 1}) \leq 0.05 \quad (1)$$

Hitherto, in a photoreceptor that has an outermost surface layer containing a polymer that is formed by polymerizing a crosslinkable charge transport material having an aromatic group and a —$CH_2OH$ group, a cleaning property has been poor, and image deletion (which refers to a phenomenon in which image blurring occurs due to the deterioration of surface charge retentivity and lateral flow of the charge) has occurred in some cases.

On the other hand, in the photoreceptor according to the exemplary embodiment, since the photoreceptor has a configuration described above, the surface charge retentivity, the cleaning property of the outermost surface layer of the photoreceptor, and image deletion resistance over a long time are excellent, and stabilized images are obtained. Though unclear, the reason is assumed to be as below.

When a crosslinkable charge transport material having a reactive hydroxyl group (an OH group in a —$CH_2OH$ group) is heated in the presence of an acid catalyst, the terminal hydroxyl groups are easily dehydrated. If this reaction is used for the crosslinkable charge transport material having a polyfunctional hydroxyl group, a cured film is obtained.

Here, actually, in the reaction process, several side reactions are caused in addition to a "dehydration condensation reaction" as a main reaction.

For example, the reaction of a crosslinkable charge transport material (I-8) having the following structure that has an aromatic group and a —$CH_2OH$ group will be described. Regarding the dehydration reaction of the crosslinkable charge transport material (I-8) caused by an acid catalyst, not all types of the reactions have been clarified. However, examples of the side reaction caused in addition to the main reaction (dehydration condensation reaction) include an elimination reaction (side reaction example 1) in which formaldehyde is eliminated from an alkyl ether group (—$CH_2OCH_2$—) generated by the dehydration condensation, and an aromatic aldehyde generation reaction (side reaction example 2) that is considered to be caused by the oxidation of the crosslinkable charge transport material (I-8).

[Chem. 1]

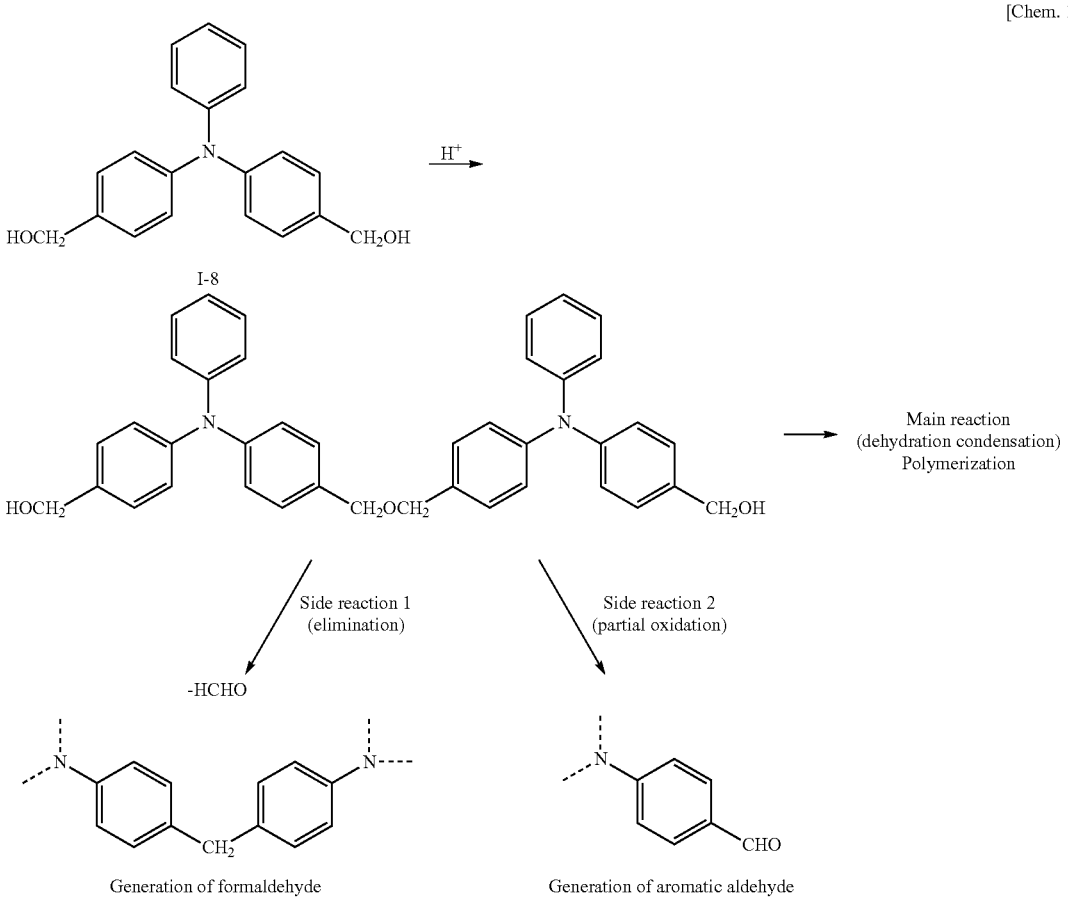

The aromatic aldehyde generated particularly by the side reaction example 2 among the above side reaction examples is known to be the cause of the image deletion. That is, by the action of an electron-attracting property of the aromatic aldehyde, charge mobility is reduced. In addition, presumably, when used for a long time, the photoreceptor is easily affected by oxidizing gas such as NOx, SOx, and ozone, and the surface charge retentivity also deteriorates. As a result, presumably, when a material that includes the aromatic aldehyde generated by the side reaction 2 is used as the outermost surface layer of an electrophotographic photoreceptor, the cleaning property deteriorates, and the image deletion occurs in the obtained images, whereby it is difficult to remain stable image quality for a long time.

On the other hand, in the photoreceptor according to the exemplary embodiment, when an infrared absorption spectrum of the outermost surface layer is measured, provided that a peak area of an absorption peak (from 1550 $cm^{-1}$ to 1650 $cm^{-1}$) of stretching vibration of an aromatic group (—CH═CH—) is (Peak 1), and that a peak area of an absorption peak (from 1670 $cm^{-1}$ to 1710 $cm^{-1}$) of an aromatic aldehyde is (Peak 2), a value of "(Peak 2)/(Peak 1)" is 0.05 or less.

Presumably, if the value of (Peak 2)/(Peak 1) is suppressed to the above range, the content of the aromatic aldehyde in the outermost surface layer is reduced, and consequently, in the outermost surface layer of the photoreceptor according to the exemplary embodiment, the surface charge retentivity, the cleaning property, and the image deletion resistance over a long time become excellent.

In addition, the value of (Peak 2)/(Peak 1) is more desirably 0.03 or less.

Control Method

As a method of controlling the value of (Peak 2)/(Peak 1) within the above range, first, a method is effective in which the crosslinkable charge transport material including an aromatic group and a —$CH_2OH$ group is polymerized by being heated under a nitrogen atmosphere. Presumably, this is because the generation of aromatic aldehyde caused by oxidation resulting from oxygen in the atmosphere is inhibited.

Moreover, it is also effective to create a mild condition of temperature and time for curing (heating) in the atmosphere or in a nitrogen atmosphere. The curing temperature is desirably 160° C. or less, and the curing time is desirably within 40 minutes. Presumably, by creating a mild curing condition, oxidation is inhibited. It is also considered that the generation (side reaction example 2) of an aromatic aldehyde is caused by the oxidation resulting from formaldehyde generated in the side reaction example 1. However, presumably, by creating a mild curing condition as described above, the oxidation caused by formaldehyde is also inhibited.

Here, in view of effectively conducting the reaction of hydroxyl groups, the curing temperature is desirably 120° C. or higher, and the curing time is desirably 20 minutes or longer.

In the polymerization of the crosslinkable charge transport material having an aromatic group and a —$CH_2OH$ group, it is also effective to form a copolymer of this crosslinkable charge transport material and a crosslinkable charge transport material having a reactive alkoxyl group.

The polymerization reaction between the crosslinkable charge transport material (hydroxyl group-containing charge transport material (A)) having an aromatic group and a —$CH_2OH$ group and a crosslinkable charge transport material (alkoxyl group-containing charge transport material (B)) having a reactive alkoxyl group is a curing reaction in which 3 types of condensation reactions such as a dehydration reaction of reactive hydroxyl groups as terminal groups of the hydroxyl group-containing charge transport material (A), a dealcoholization reaction between the reactive alkoxyl group as a terminal group of the alkoxyl group-containing charge transport material (B) and a hydrogen atom at a p-position in an aromatic ring of both the charge transport materials, and a dealcoholization reaction between the reactive hydroxyl group and reactive alkoxyl group are coupled together in a complicated manner. At this time, presumably, due to the difference inactivation energy between the reactive hydroxyl group and the reactive alkoxyl group, the curing reactions shows differences in the reaction rate, and the hydroxyl group-containing charge transport material (A) is more rapidly cured. Presumably, since the curing reaction shows differences in the reaction rate due to the differences in activation energy between the reactive hydroxyl group and the reactive alkoxyl group, the hydroxyl group of the hydroxyl group-containing charge transport material (A) that remains without reacting reacts with the alkoxyl group of the alkoxyl group-containing charge transport material (B) that reacts more slowly, and the amount of the residual unreacted hydroxyl group remaining in the outermost surface layer is reduced, whereby the occurrence of partial oxidation (side reaction example 2) is inhibited.

Measurement Method of Infrared Absorption Spectrum

The measurement method of the infrared absorption spectrum of the outermost surface layer is not particularly limited, and known measurement methods may be used. For example, the infrared absorption spectrum may be measured by various methods such as a method in which a coating liquid for forming an outermost surface layer is coated onto an aluminum substrate as a single layer or onto a photosensitive layer stacked on the aluminum substrate, followed by drying and curing, and then the surface of the obtained cured film is measured by an ATR method; a method in which the cured film is peeled and measured by a penetration method; and a method in which the cured film is scraped off and then measured by a KBr method or a nujol method.

Next, the configuration of the photoreceptor in the exemplary embodiment will be described.

Configuration of Photoreceptor

The photoreceptor according to the exemplary embodiment may have a functional integration type of photosensitive layer that has both a charge transporting function and a charge generating function or a functional separation type of photosensitive layer that includes a charge transporting layer and a charge generating layer. Moreover, other layers such as an undercoat layer, a protective layer, and the like may also be provided in the photoreceptor.

Hereinafter, the configuration of the photoreceptor in the exemplary embodiment will be described with reference to FIGS. 1 and 2, but the exemplary embodiment is not limited to FIGS. 1 and 2.

FIG. 1 is a schematic cross-sectional view showing an example of the layer configuration of the photoreceptor in the exemplary embodiment. In FIG. 1, 1 indicates a conductive substrate, 2 indicates a photosensitive layer, 2A indicates a charge generating layer, 2B indicates a charge transporting layer, 2C indicates a protective layer, and 4 indicates an undercoat layer.

The photoreceptor shown in FIG. 1 has a layer configuration in which an undercoat layer 4, a charge generating layer 2A, a charge transporting layer 2B, and a protective layer 2C are layered on a conductive substrate 1 in this order. A photosensitive layer 2 is configured with three layers including the charge generating layer 2A, the charge transporting layer 2B, and the protective layer 2C (photoreceptor of a first embodiment).

In addition, in the photoreceptor shown in FIG. 1, the protective layer 2C is an outermost surface layer.

Figure 2:
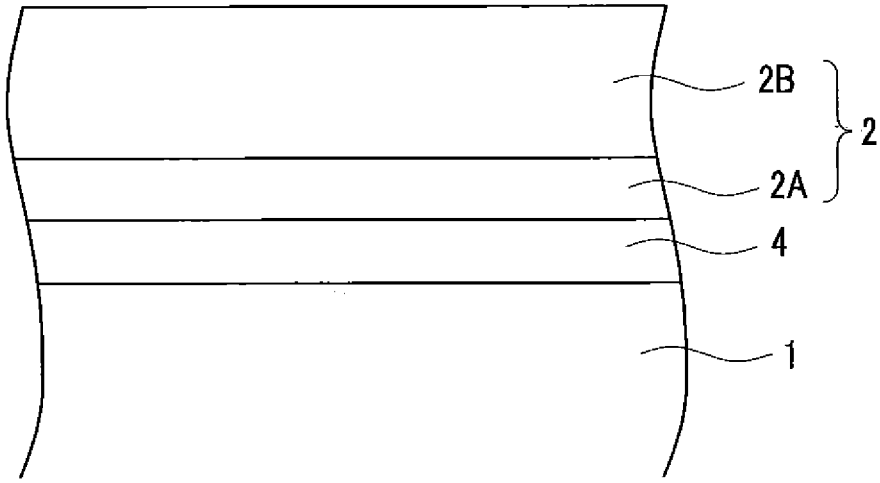
FIG. 2 is a schematic partial cross-sectional view showing an electrophotographic photoreceptor of a second embodiment used in the exemplary embodiment.

FIG. 2 is a schematic cross-sectional view showing another example of the layer configuration of the photoreceptor in the exemplary embodiment, and the reference numerals shown in FIG. 2 are the same as those shown in FIG. 1.

The photoreceptor shown in FIG. 2 has a layer configuration in which the undercoat layer 4, the charge generating layer 2A, and the charge transporting layer 2B are layered on the conductive substrate 1 in this order. The photosensitive layer 2 is configured with two layers including the charge generating layer 2A and the charge transporting layer 2B (photoreceptor of a second embodiment).

In addition, in the photoreceptor shown in FIG. 2, the charge transporting layer 2B is the outermost surface layer.

In the embodiment shown in FIG. 1, three layers including the charge generating layer 2A, the charge transporting layer 2B, and the protective layer 2C configure the photosensitive layer 2 as described above. However, in addition to this configuration, as an embodiment of the photosensitive layer 2, an embodiment that has the charge transporting layer 2B, the charge generating layer 2A, and the protective layer 2C in this order from the conductive substrate 1 side, an embodiment that has a functional integration type of photosensitive layer having both a charge transporting function and a charge generating function and the protective layer 2C, or the like may also be employed.

Hereinafter, as examples of the photoreceptor in the exemplary embodiment, the above first and second embodiments will be described respectively.

[Photoreceptor of First Embodiment: Outermost Surface Layer=Protective Layer]

As shown in FIG. 1, the photoreceptor of the first embodiment has a layer configuration in which the undercoat layer 4, the charge generating layer 2A, the charge transporting layer 2B, and the protective layer 2C are layered on the conductive substrate 1 in this order, and the protective layer 2C is an outermost surface layer.

Conductive Substrate

As the conductive substrate 1, a conductive substrate having conductivity is used. Examples of the conductive substrate include a metal plate, a metal drum, and a metal belt configured with metals such as aluminum, copper, zinc, stainless steel, chromium, nickel, molybdenum, vanadium, indium, gold, and platinum, or an alloy thereof; or paper, a plastic film, a belt and the like onto which a conductive compound such as a conductive polymer or indium oxide, a metal such as aluminum, palladium, or gold or an alloy thereof is coated, vapor-deposited, or laminated. Herein, the word "conductive" means that a volume resistivity is less than $10^{13}\Omega$cm.

When the photoreceptor of the first embodiment is used for a laser printer, the surface of the conductive substrate 1 is desirably made into a rough surface having a center line average roughness Ra of from 0.04 μm to 0.5 μm. Here, when incoherent light is used as a light source, it is not particularly necessary to roughen the surface.

As a method of roughening the surface, wet honing in which an abrading agent is suspended in water and sprayed to a supporter, centerless grinding in which grinding is continuously performed while a supporter is brought into contact with a spinning grindstone, anodization, or the like is desirable.

As another method of roughening the surface, a method is also desirably used in which conductive or semi-conductive powder is dispersed in a resin so as to form a layer on the surface of a supporter, and the surface is roughened by the particles dispersed in the layer, without roughening the surface of the conductive substrate 1.

Herein, in the surface roughening performed by anodization, anodization is conducted in an electrolyte solution by using aluminum as an anode, thereby forming an oxide film on the surface of aluminum. Examples of the electrolyte solution include a sulfuric acid solution, an oxalic acid solution, and the like. However, since the porous anodized oxide film formed by anodization is chemically active as it is, it is therefore desirable to perform sealing in which the fine porous of the anodized oxide film is blocked by volume expansion caused by a hydration reaction in steam under pressure or in boiling water (a metal salt such as nickel may be added), thereby changing the film into a more stabilized hydrated oxide. The thickness of the anodized oxide film is desirably from 0.3 μm to 15 μm.

The conductive substrate 1 may also be treated with an aqueous acidic solution or boehmite.

The treatment using an acidic treatment liquid containing phosphoric acid, chromic acid, and hydrofluoric acid is performed in the following manner. First, the acidic treatment liquid is prepared. As a mixing ratio between the phosphoric acid, chromic acid, and hydrofluoric acid in the acidic treatment liquid, the phosphoric acid is in a range of from 10% by mass to 11% by mass, the chromic acid is in a range of from 3% by mass to 5% by mass, and the hydrofluoric acid is in a range of from 0.5% by mass to 2% by mass. The concentration of all these acids is desirably from 13.5% by mass to 18% by mass. The treatment temperature is desirably from 42° C. to 48° C., and the film thickness of the coat is desirably from 0.3 μm to 15 μm.

In the boehmite treatment, the conductive substrate 1 is dipped in ultrapure water at from 90° C. to 100° C. for from 5 minutes to 60 minutes, or brought into contact with heated steam at from 90° C. to 120° C. for from 5 minutes to 60 minutes. The film thickness of the coat is desirably from 0.1 μm to 5 μm. The obtained resultant may be anodized using an electrolyte solution having low coat solubility compared to other electrolytes, such as adipic acid, boric acid, a boric acid salt, a phosphoric acid salt, a phthalic acid salt, a maleic acid salt, a benzoic acid salt, a tartaric acid salt, and a citric acid salt.

Undercoat Layer

The undercoat layer 4 is configured as, for example, a layer containing a binder resin and inorganic particles.

As the inorganic particles, particles having powder resistance (volume resistivity) of from $10^2\Omega\cdot$cm to $10^{11}\Omega\cdot$cm are desirably used.

Among the inorganic particles, as the inorganic particles having the resistance value described above, inorganic particles (conductive metal oxide) of tin oxide, titanium oxide, zinc oxide, zirconium oxide, and the like are desirably used, and particularly, zinc oxide is desirably used.

The inorganic particles may also be surface-treated, and two or more kinds of particles such as particles differing in types of the surface treatment or particles differing in the particle size may be used as a mixture. The volume average particle size of the inorganic particles is desirably in a range of from 50 nm to 2000 nm (desirably from 60 nm to 1000 nm).

In addition, as the inorganic particles, particles having a specific surface area of 10 $m^2/g$ or more measured by a BET method are desirably used.

The undercoat layer may further contain an acceptor compound in addition to the inorganic particles. Any compound may be used as the acceptor compound, but charge transporting materials including a quinone-based compound such as chloranil or bromanil; a tetracyanoquinodimethane-based compound; a fluorenone compound such as 2,4,7-trinitrofluorenone or 2,4,5,7-tetranitro-9-fluorenone; an oxadiazole-based compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)1,3,4-oxadiazole; a xanthone-based compound; a thiophene compound; and a diphenoquinone compound such as 3,3',5,5'-tetra-t-butyl diphenoquinone are desirable. Particularly, compounds having an anthraquinone structure are desirable. In addition, acceptor compounds having an anthraquinone structure such as a hydroxyanthraquinone-based compound, an aminoanthraquinone-based compound, and an aminohydroxyanthraquinone-based compound are desirably used, and specific examples thereof include anthraquinone, alizarin, quinizarin, anthrarufin, purpurin, and the like.

The content of these acceptor compounds may be arbitrarily set, but desirably, the acceptor compound is contained at from 0.01% by mass to 20% by mass, based on the inorganic particles. The content is more desirably from 0.05% by mass to 10% by mass.

The acceptor compound may be simply added when the undercoat layer 4 is coated, or may be attached onto the surface of the inorganic particles in advance. Examples of a method of attaching the acceptor compound onto the surface of the inorganic particles include a dry method and a wet method.

When the surface treatment is performed by the dry method, while the inorganic particles are stirred with a mixer or the like having a strong shearing force, the acceptor compound is added dropwise thereto as it is or after dissolved in an organic solvent, and the resultant is sprayed together with dry air or nitrogen gas, thereby treating the surface of the inorganic particles. The addition or spraying is performed desirably at a temperature equal to or lower than the boiling point of the solvent. After the addition or spraying, baking may be performed at 100° C. or a higher temperature. The baking is performed in an arbitrary range of temperature and time.

As the wet method, the inorganic particles are dispersed in a solvent by stirring, ultrasonic waves, a sand mill, an attritor, a ball mill, or the like, and the acceptor compound is added thereto. Subsequently, the resultant is stirred or dispersed, and then the solvent is removed, whereby the surface is treated. As a method of removing the solvent, the solvent is distilled away by filtering or distillation. After the solvent is removed, baking may be performed at 100° C. or a higher temperature. The baking is performed in an arbitrary range of temperature and time. In the wet method, moisture contained in inorganic particles may be removed before a surface treatment agent is added, and for example, a method of removing the moisture while stirring and heating the solvent used for the surface treatment, or a method of removing the moisture by causing azeotropy of the solvent and moisture may be used.

The inorganic particles may be surface-treated before the acceptor compound is imparted. The surface treatment agent may be selected from known materials. Examples of the surface treatment agent include a silane coupling agent, a titanate-based coupling agent, an aluminum-based coupling agent, a surfactant, and the like. Particularly, a silane coupling agent is desirably used. Moreover, a silane coupling agent having an amino group is also desirably used.

As the silane coupling agent having an amino group, any agent may be used. Specific examples thereof include γ-aminopropyl triethoxysilane, N-β-(aminoethyl)-γ-aminopropyl trimethoxysilane, N-β-(aminoethyl)-γ-aminopropylmethyl dimethoxysilane, N,N-bis(β-hydroxyethyl)-γ-aminopropyl triethoxysilane, and the like, but the agent is not limited thereto.

The silane coupling agent may be used as a mixture of two or more kinds thereof. Examples of the silane coupling agent that may be used concurrently with the silane coupling agent having an amino group include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl dimethoxysilane, N,N-bis(β-hydroxyethyl)-γ-aminopropyl triethoxysilane, γ-chloropropyl trimethoxysilane, and the like, but the silane coupling agent is not limited thereto.

Any method may be used as the surface treatment method as long as the method is a known method, but it is desirable to use the dry method or wet method. Moreover, imparting the acceptor compound and surface treatment performed using the a silane coupling agent may be conducted at the same time.

The amount of the silane coupling agent based on the inorganic particles in the undercoat layer 4 may be arbitrarily set. However, the amount is desirably from 0.5% by mass to 10% by mass based on the inorganic particles.

As the binder resin contained in the undercoat layer 4, any known resin may be used. For example, known polymeric resin compounds such as an acetal resin including polyvinyl butyral, a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and a urethane resin, a charge transporting resin having a charge transporting group, a conductive resin such as polyaniline, and the like are used. Among these, a resin insoluble in a coating solvent of the upper layer is desirably used, and particularly, a phenol resin, a phenol-formaldehyde resin, a melamine resin, a urethane resin, an epoxy resin, and the like are desirably used. When these resins are used in combination of two or more kinds thereof, the mixing ratio is set according to necessity.

The proportion between the metal oxide to which an acceptor property has been imparted and the binder resin, or between the inorganic particles and the binder resin in the coating liquid for forming an undercoat layer is arbitrarily set.

Various additives may be used for the undercoat layer 4. As the additives, known materials such as a polycyclic condensed type or azo-based electron transporting pigment, a zirconium chelate compound, a titanium chelate compound, an aluminum chelate compound, a titanium alkoxide compound, an organic titanium compound, and a silane coupling agent are used. Though used for surface treatment of the metal oxide, the silane coupling agent may also be further added to the coating liquid as an additive. Specific examples of the silane coupling agent used include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl dimethoxysilane, N,N-bis(β-hydroxyethyl)-γ-aminopropyl triethoxysilane, γ-chloropropyl trimethoxysilane, and the like.

Examples of the zirconium chelate compound include zirconium butoxide, zirconium acetoethyl acetate, zirconium triethanolamine, acetylacetonate zirconium butoxide, acetoethyl acetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Examples of the titanium chelate compound include tetraisopropyl titanate, tetra-n-butyl titanate, a butyl titanate dimer, tetra(2-ethylhexyl)titanate, titanium acetylacetonate, polytitanium acetylacetonate, titanium octyleneglycolate, a titanium lactate ammonium salt, titanium lactate, titanium lactate ethyl ester, titanium triethanol aminate, polyhydroxy titanium stearate, and the like.

Examples of the aluminum chelate compound include aluminum isopropylate, monobutoxyaluminum diisopropylate, aluminum butyrate, ethyl acetoacetate aluminum diisopropylate, aluminum tris(ethylacetoacetate), and the like.

These compounds may be used alone, as a mixture of plural compounds, or as a polycondensate.

The solvent for preparing the coating liquid for forming an undercoat layer is selected from known organic solvents based on, for example, alcohols, aromatic compounds, halogenated hydrocarbons, ketones, ketone alcohols, ethers, esters, and the like. As the solvent, general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene are used, for example.

These solvents used for dispersion may be used alone or as a mixture of two or more kinds thereof. When the solvents are mixed, any solvent may be used as long as the solvent is able to dissolve the binder resin as a mixed solvent.

As a dispersing method, known methods such as methods using a roll mill, a ball mill, a vibration ball mill, an attritor, a sand mill, a colloid mill, or a paint shaker are used. As the coating method used for providing the undercoat layer 4, a general method such as blade coating, wire bar coating, spray coating, dip coating, bead coating, air knife coating, or curtain coating is used.

By using the coating liquid for forming an undercoat layer obtained in this manner, the undercoat layer 4 is formed on the conductive substrate 1.

The undercoat layer 4 desirably has a Vickers' hardness of 35 or more.

The thickness of the undercoat layer 4 may be arbitrarily set, but the thickness is desirably 15 μm or more, and more desirably from 15 μm to 50 μm.

In order to prevent a moire image, the surface roughness (ten-point average roughness) of the undercoat layer 4 is adjusted to from ¼ n (n is a refractive index of the upper layer) to ½ λ of a wavelength λ of a laser used for exposure. To adjust the surface roughness, particles of a resin or the like may be added to the undercoat layer. As the resin particles, silicone resin particles, crosslinked polymethylmethacrylate resin particles, and the like are used.

The undercoat layer 4 desirably includes the binder resin and conductive metal oxide and has a light transmittance of 40% or less (more desirably from 10% to 35%, and even more desirably from 15% to 30%) with respect to light having a wavelength of 950 nm at a thickness of 20 μm.

The light transmittance of the undercoat layer is measured in the following manner. The coating liquid for forming an undercoat layer is coated onto a glass plate so as to yield a thickness of 20 μm after drying, followed by drying, and the light transmittance of the film at a wavelength of 950 nm is measured using a spectrophotometer. To measure the light transmittance with a photometer, a device named "Spectrophotometer (U-2000): manufactured by Hitachi, Ltd. is used as a spectrophotometer.

The light transmittance of the undercoat layer may be controlled by adjusting the time of the dispersing which is performed using a roll mill, a ball mill, a vibration ball mill, an attritor, a sand mill, a colloid mill, or a paint shaker. Though not particularly limited, the dispersing time is desirably from 5 minutes to 1000 hours, and more desirably from 30 minutes to 10 hours. As the dispersing time increases, the light transmittance tends to decrease.

The undercoat layer may be polished to adjust the surface roughness. As the polishing method, buffing, sand blasting, wet honing, grinding, and the like are used.

By drying the product coated with the coating liquid, the undercoat layer is obtained. Generally, drying is performed at a temperature at which a film may be formed by the evaporation of the solvent.

Charge Generating Layer

The charge generating layer 2A desirably contains at least a charge generating material and a binder resin.

Examples of the charge generating material include an azo pigment such as bisazo or trisazo, a condensed cyclic aromatic pigment such as dibromoanthanthrone, a perylene pigment, a pyrrolopyrrole pigment, a phthalocyanine pigment, zinc oxide, trigonal selenium, and the like. Among these, for laser exposure of a near-infrared region, metallic and metal-free phthalocyanine pigments are desirable. Particularly, hydroxy gallium phthalocyanine disclosed in JP-A-5-263007 and JP-A-5-279591, chlorogallium phthalocyanine disclosed JP-A-5-98181, dichlorotin phthalocyanine disclosed in JP-A-5-140472 and JP-A-5-140473, and titanyl phthalocyanine disclosed in JP-A-4-189873 and JP-A-5-43823 are more desirable. In addition, for the laser exposure of a near-ultraviolet region, a condensed cyclic aromatic pigment such as dibromoanthanthrone, a thioindigo-based pigment, a porphyrazine compound, zinc oxide, trigonal selenium, and the like are more desirable. As the charge generating material, inorganic pigments are desirable when a light source of an exposure wavelength of from 380 nm to 500 nm is used, and metallic and metal-free phthalocyanine pigments are desirable when a light source of an exposure wavelength of from 700 nm to 800 nm is used.

As the charge generating material, it is desirable to use a hydroxy gallium phthalocyanine pigment that has a maximum peak wavelength in a range of from 810 nm to 839 nm, in a spectroscopic absorption spectrum within a wavelength region of from 600 nm to 900 nm. This hydroxy gallium phthalocyanine pigment is different from a V type hydroxy gallium phthalocyanine pigment in the related art, and is obtained by shifting the maximum peak wavelength of the spectroscopic absorption spectrum to a shorter wavelength side compared to the V type hydroxy gallium phthalocyanine pigment in the related art.

The average particle size of the hydroxy gallium phthalocyanine pigment that has a maximum peak wavelength in a range of from 810 nm to 839 nm is desirably within a specific range, and a BET specific surface area thereof is desirably within a specific range. Specifically, the average particle size is desirably 0.20 μm or less, and more desirably from 0.01 μm to 0.15 μm. The BET specific surface area is desirably 45 $m^2/g$ or more, more desirably 50 $m^2/g$ or more, and particularly desirably from 55 $m^2/g$ to 120 $m^2/g$. The average particle size is a value measured in terms of a volume average particle size (d50 average particle size) by using a laser diffraction scattering type particle size distribution measuring device (LA-700, manufactured by HORIBA, Ltd.) In addition, this value is measured using a BET type specific surface area measuring device (manufactured by Shimadzu Corporation, Flowsorp II2300) through a nitrogen substitution method.

The maximum particle size (a maximum value of primary particle size) of the hydroxy gallium phthalocyanine pigment is desirably 1.2 μm or less, more desirably 1.0 μm or less, and even more desirably 0.3 μm or less.

The hydroxy gallium phthalocyanine pigment desirably has an average particle size of 0.2 μm or less, a maximum particle size of 1.2 μm or less, and a specific surface area of 45 $m^2/g$ or more.

The hydroxy gallium phthalocyanine pigment desirably has diffraction peaks at Bragg angle ($2\theta \pm 0.2°$) of 7.5°, 9.9°, 12.5°, 16.3°, 18.6°, 25.1°, and 28.3°, in an X-ray diffraction spectrum using X-rays having Cuk$\alpha$ characteristics.

The thermal weight loss ratio at the time when the hydroxy gallium phthalocyanine pigment is heated up to 400° C. from 25° C. is desirably from 2.0% to 4.0%, and more desirably from 2.5% to 3.8%.

The binder resin used for the charge generating layer 2A is selected from a wide range of insulating resins. Moreover, the binder resin may be selected from organic photoconductive polymers such as poly-N-vinylcarbazole, polyvinylanthracene, polyvinylpyrene, and polysilane. Examples of desirable binder resins include a polyvinyl butyral resin, a polyarylate resin (a polycondensate of bisphenols and aromatic divalent carboxylic acid or the like), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, a polyvinyl pyrrolidone resin, and the like. These binder resins may be used alone or as a mixture of two or more kinds thereof. The mixing ratio between the charge generating material and the binder resin is desirably in a range of from 10:1 to 1:10, in terms of a mass ratio. Herein, the word "insulating" means that the volume resistivity is $10^{13}$ Ωcm or greater.

The charge generating layer 2A is formed using the coating liquid obtained by dispersing the charge generating material and binder resin in a solvent.

Examples of the solvent used for the dispersion include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene, and the like. These solvents may be used alone or as a mixture of two or more kinds thereof.

As the method of dispersing the charge generating material and the binder resin in a solvent, general methods such as a ball mill dispersing, attritor dispersing, sand mill dispersing, and the like are used. During the dispersion, it is effective to adjust the average particle size of the charge generating material to 0.5 μm or less, desirably 0.3 μm or less, and more desirably 0.15 μm or less.

In forming the charge generating layer 2A, general methods such as blade coating, wire bar coating, spray coating, dip coating, bead coating, air knife coating, and curtain coating are used.

The film thickness of the charge generating layer 2A obtained in this manner is desirably from 0.1 μm to 5.0 μm, and more desirably from 0.2 μm to 2.0 μm.

Charge Transporting Layer

The charge transporting layer 2B is desirably a layer containing at least a charge transporting material and a binder resin, or a layer containing a polymeric charge transport material.

Examples of the charge transport material include an electron transporting compound including quinone-based compounds such as p-benzoquinone, chloranil, bromanil and anthraquinone, a tetracyanoquinodimethane-based compound, a fluorenone compound such as 2,4,7-trinitrofluorenone, a xanthone-based compound, a benzophenone-based compound, a cyanovinyl-based compound, and an ethylene-based compound; and hole transporting compounds such as a triarylamine-based compound, a benzidine-based compound, an arylalkane-based compound, an aryl-substituted ethylene-based compound, a stilbene-based compound, an anthracene-based compound, and a hydrazone-based compound. These charge transport materials may be used alone or as a mixture of two or more kinds thereof, but are not limited to the above materials.

As the charge transport material, a triarylamine derivative represented by the following Formula (a-1), and a benzidine derivative represented by the following Formula (a-2) are desirable, in view of the charge mobility.

(a-1)

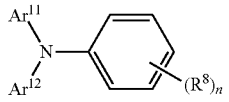

In Formula (a-1), $R^8$ represents a hydrogen atom or a methyl group. n represents 1 or 2. Each of $Ar^{11}$ and $Ar^{12}$ independently represents a substituted or unsubstituted aryl group, $—C_6H_4—C(R^9)=C(R^{10})(R^{11})$, or $—C_6H_4—CH=CH—CH=C(R^{12})(R^{13})$, and each of $R^9$ to $R^{13}$ independently represents a hydrogen atom, a substituted or unsubstituted alkyl group, or a substituted or unsubstituted aryl group. The substituent of these groups include a halogen atom, an alkyl group having from 1 to 5 carbon atoms, an alkoxy group having from 1 to 5 carbon atoms, or a substituted amino group substituted with an alkyl group having from 1 to 3 carbon atoms.

(a-2)

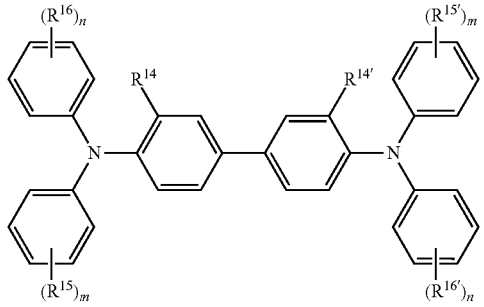

In Formula (a-2), $R^{14}$ and $R^{14'}$ may be the same as or different from each other, and each independently represents a hydrogen atom, a halogen atom, an alkyl group having from 1 to 5 carbon atoms, and an alkoxy group having from 1 to 5 carbon atoms. Each of $R^{15}$, $R^{15'}$, $R^{16}$, and $R^{16'}$ may be the same as or different from each other, and each independently represents a hydrogen atom, a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, $—C(R^{17})=C(R^{18})(R^{19})$, or $—CH=CH—CH=C(R^{20})(R^{21})$ and each of $R^{17}$ to $R^{21}$ independently represents a hydrogen atom, a substituted or unsubstituted alkyl group, or a substituted or unsubstituted aryl group. Each of m and n independently represents an integer of from 0 to 2.

Herein, among the triarylamine derivative represented by the Formula (a-1) and the benzidine derivative represented by the Formula (a-2), a triarylamine derivative having "$—C_6H_4—CH=CH—CH=C(R^{12})(R^{13})$" and a benzidine derivative having "$—CH=CH—CH=C(R^{20})(R^{21})$" are particularly desirable.

In addition, as the charge transport material, a polymeric charge transport material may be used. As the polymeric charge transport material, known materials having a charge transport property, such as poly-N-vinylcarbazole and polysilane, are used. Particularly, polyester-based polymeric charge transport materials disclosed in JP-A-8-176293 and JP-A-8-208820 are desirable. The polymeric charge transport material may be able to form a film as it is, but the material may be mixed with the binder resin described later to form a film.

Examples of the binder resin used for the charge transporting layer 2B include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, a poly-N-vinyl carbozole, polysilane, and the like. Moreover, as described above, polyester-based polymeric charge transport materials disclosed in JP-A-8-176293 and JP-A-8-208820 may also be used. These binder resins may be used alone or as a mixture of two or more kinds thereof. The mixing ratio between the charge transport material and the binder resin is desirably from 10:1 to 1:5 in terms of a mass ratio.

Though not particularly limited, the binder resin is desirably at least any one of a polycarbonate resin having a viscosity average molecular weight of from 50000 to 80000 and a polyacrylate resin having a viscosity average molecular weight of from 50000 to 80000.

The charge transporting layer 2B is formed using a coating liquid for forming a charge transporting layer that contains the above-described constituent materials. As the solvent used for the coating liquid for forming a charge transporting layer, general organic solvents including aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether are used alone or as a mixture of two or more kinds thereof. As the method of dispersing the respective constituent materials, known methods are used.

As the method of coating the coating liquid for forming a charge transporting layer onto the charge generating layer 2A, general methods such as blade coating, wire bar coating, spray coating, dip coating, bead coating, air knife coating, and curtain coating are used.

The film thickness of the charge transporting layer 2B is desirably from 5 μm to 50 μm, and more desirably from 10 μm to 30 μm.

Protective Layer (Charge Transport Material)

For the outermost surface layer (protective layer 2C in the first embodiment), a crosslinkable charge transport material (hydroxyl group-containing charge transport material (A)) that has an aromatic group and a —$CH_2OH$ group, and a crosslinkable charge transport material (alkoxyl group-containing charge transport material (B)) that has a reactive alkoxyl group are desirably used as the charge transport material.

In addition, the outermost surface layer (protective layer 2C) is formed by polymerizing the hydroxyl group-containing charge transport material (A) and the alkoxyl group-containing charge transport material (B), by using desirably 90% by mass or more, more desirably 94% by mass or more of those materials based on all monomers to be a solid content. The upper limit of the amount is not limited as long as additives such as a guanamine compound, an antioxidant, and a curing catalyst described later function effectively in the amount, but the more amount the more desirable.

As the hydroxyl group-containing charge transport material (A), a compound represented by the following Formula (I-1) is particularly desirable, and as the alkoxyl group-containing charge transport material (B), a compound represented by the following Formula (I-2) is particularly desirable.

$$F^1—(L^1—OH)_n \quad \text{(I-1)}$$

[In Formula (I-1), $F^1$ represents an organic group derived from a compound having a hole transport property and an aromatic group, $L^1$ represents a linear or branched alkylene group having from 1 to 5 carbon atoms, and n represents an integer of from 1 to 4.]

$$F^2—(L^2—OR)_m \quad \text{(I-2)}$$

[In Formula (I-2), $F^2$ represents an organic group derived from a compound having a hole transport property, $L^2$ represents a linear or branched alkylene group having from 1 to 5 carbon atoms, R represents an alkyl group, and m represents an integer of from 1 to 4.]

In Formulae (I-1) and (I-2), it is desirable that each of the substituent numbers n and m independently represent 2 or a greater number.

In Formulae (I-1) and (I-2), examples of the compound having a hole transport property in the organic group which is derived from the compound having a hole transport property and represented by $F^1$ and $F^2$ suitably include an arylamine derivative. Examples of the arylamine derivative suitably include a triphenylamine derivative and a tetraphenylbenzidine derivative.

The compound represented by Formula (I-1) is desirably a compound having a structure represented by the following Formula (II-1) and the compound represented by Formula (I-2) is desirably a compound having a structure represented by the following Formula (II-2).

(II)-1

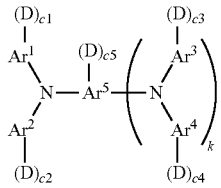

In Formula (II-1), $Ar^1$ to $Ar^4$ may be the same as or different from each other, and each independently represents a substituted or unsubstituted aryl group; $Ar^5$ represents a substituted or unsubstituted aryl group or a substituted or unsubstituted arylene group; D represents —($L^1$—OH); each c1 to c5 independently represents 0 or 1; k represents 0 or 1; and the total number of D is from 1 to 4; and $L^1$ represents a linear or branched alkylene group having from 1 to 5 carbon atoms.

(II)-2

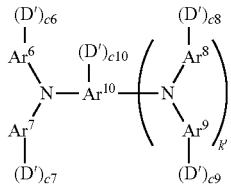

In Formula (II-2), $Ar^6$ to $Ar^9$ may be the same as or different from each other, and each independently represents a substituted or unsubstituted aryl group; $Ar^{10}$ represents a substituted or unsubstituted aryl group or a substituted or unsubstituted arylene group; D' represents —($L^2$—OR); each c independently represents 0 or 1; k' represents 0 or 1; the total number of D' is from 1 to 4; $L^2$ represents a linear or branched alkylene group having from 1 to 5 carbon atoms; and R represents an alkyl group.

The total number of D, D' in Formulae (II-1) and (II-2) corresponds to n in Formula (I-1) and m in Formula (I-2), respectively. This number is desirably from 2 to 4, and more desirably from 3 to 4. That is, Formulae (I-1) and (I-2) or Formulae (II-1) and (II-2) include desirably from 2 to 4, and more desirably from 3 to 4 reactive functional groups (that is, —OH or —OR) in a molecule.

In Formulae (II-1) and (II-2), $Ar^1$ to $Ar^{10}$ are desirably any one of the following Formulae (1) to (7). In the following Formulae (1) to (7), "—$(D)_c$" in common means "—$(D)_{c1}$" to "—$(D)_{c5}$" linked to $Ar^1$ to $Ar^5$ respectively and "—$(D')_{c6}$" to "—$(D')_{c10}$" linked to $Ar^6$ to $Ar^{10}$ respectively.

(1)

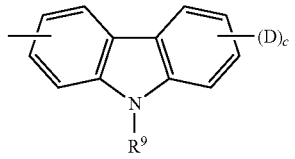

(2)

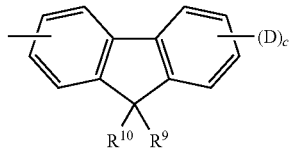

-continued (3)

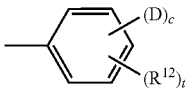

(4)

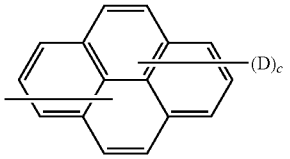

(5)

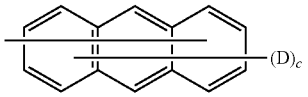

(6)

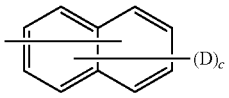

(7)

In Formulae (1) to (7), $R^9$ represents one kind selected from a group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms; each of $R^{10}$ to $R^{12}$ represents one kind selected from a group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c have the same definition as that of "D", "D" and "c1 to c10" in Formulae (II-1) and (II-2); each s represents 0 or 1; and t represents an integer of from 1 to 3.

Herein, Ar in Formula (7) is desirably represented by the following Formula (8) or (9).

(8)

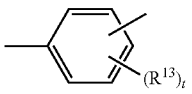

(9)

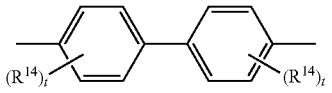

In Formulae (8) and (9), each of $R^{13}$ and $R^{14}$ represents one kind selected from a group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen group; and t represents an integer of from 1 to 3.

In Formula (7), Z' is desirably represented by any one of the following Formulae (10) to (17).

(10)

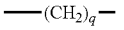

(11)

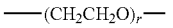

(12)

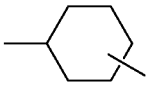

(13)

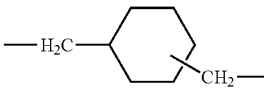

(14)

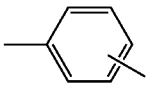

(15)

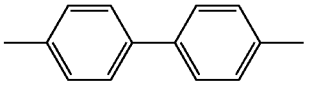

(16)

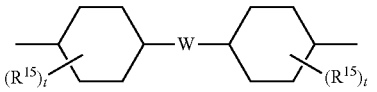

(17)

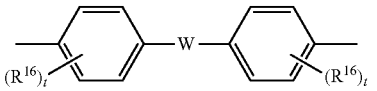

In Formulae (10) to (17), each of $R^{15}$ and $R^{16}$ independently represents one kind selected from a group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, an aralkyl group having from 7 to 10 carbon atoms, and a halogen atom; W represents a divalent group, each of q and r represents an integer of from 1 to 10; and each t represents an integer of from 1 to 3.

In the above Formulae (16) and (17), W is desirably any one of the divalent groups represented by the following (18) to (26). Here, in Formula (25), u represents an integer of from 0 to 3.

(18)

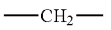

(19)

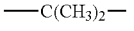

(20)

(21)

(22)

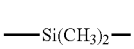

(23)

(24)

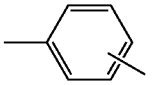

-continued (25)

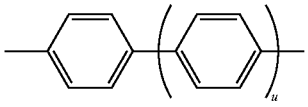

(26)

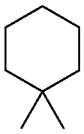

In Formulae (II-1), when k is 0, $Ar^5$ is an aryl group of the above (1) to (7) that is exemplified in the description of $Ar^1$ to $Ar^4$. When k is 1, $Ar^5$ is desirably an arylene group that is obtained by removing one hydrogen atom from the aryl group of the above (1) to (7).

In Formulae (II-2), when k' is 0, $Ar^{10}$ is an aryl group of the above (1) to (7) that is exemplified in the description of $Ar^6$ to $Ar^9$. When k' is 1, $Ar^{10}$ is desirably an arylene group that is obtained by removing one hydrogen atom from the aryl group of the above (1) to (7).

In Formulae (I-1) and (I-2), as the organic groups that are derived from the compound having a hole transporting function and is represented by $F^1$ and $F^2$, a triphenylamine skeleton, an N,N,N',N'-tetraphenyl benzidine skeleton, a stilbene skeleton, or a hydrazone skeleton is particularly desirable. Among these, a triphenylamine skeleton or an N,N,N',N'-tetraphenyl benzidine skeleton is desirable.

These organic groups may have a substituent, and as the substituent, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, or a halogen atom is desirable. Among these, an alkyl group having from 1 to 4 carbon atoms or an alkoxy group having from 1 to 4 carbon atoms is desirable.

As the linear or branched alkylene group having from 1 to 5 carbon atoms and represented by $L^1$ and $L^2$, a methylene group, an ethylene group, or —$CH(CH_3)$— is particularly desirable. Among these, a methylene group is desirable.

As the alkyl group represented by R, a methyl group, an ethyl group, a propyl group, or an isopropyl group is desirable. Among these, a methyl group is desirable.

Herein, specific examples of the compound represented by Formula (I-1) include the following ones, but the compound is not limited thereto.

I-2

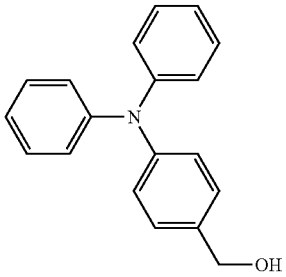

-continued

I-3

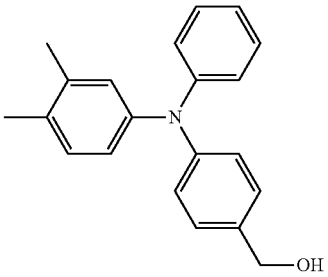

I-4

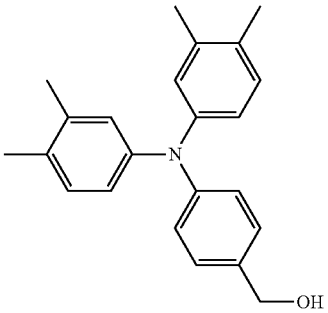

I-5

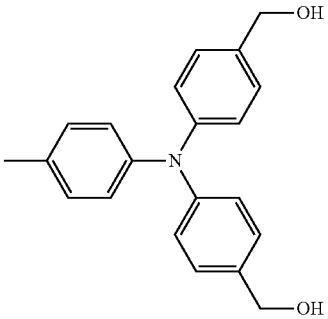

I-6

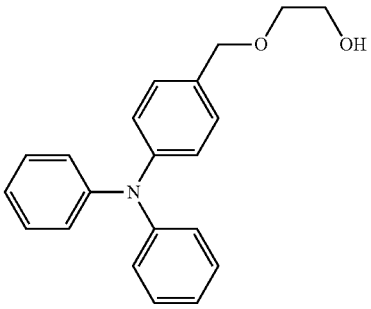

I-7

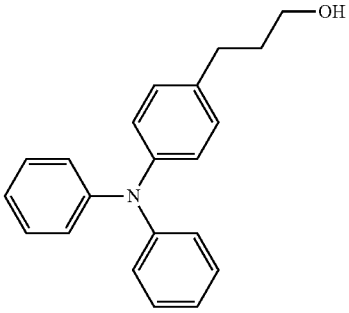

-continued
I-8
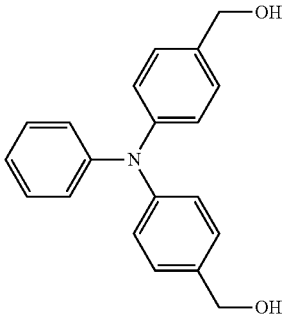
I-9
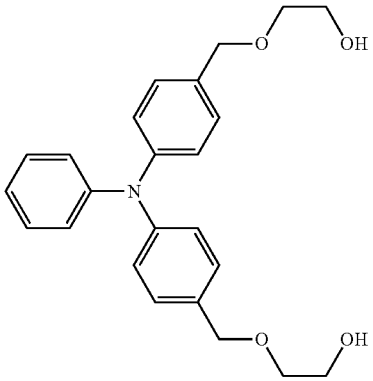
I-10
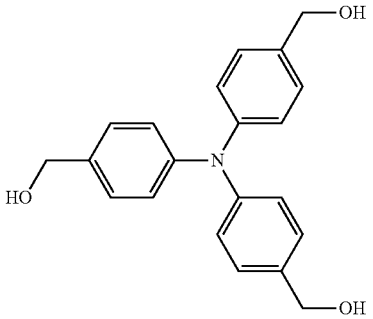
I-11
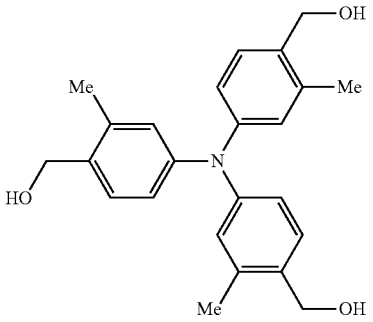
-continued
I-12
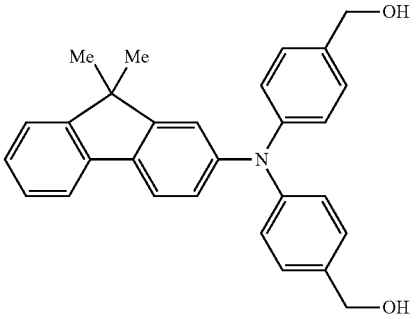
I-13
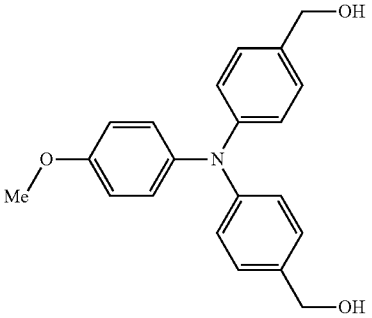
I-14
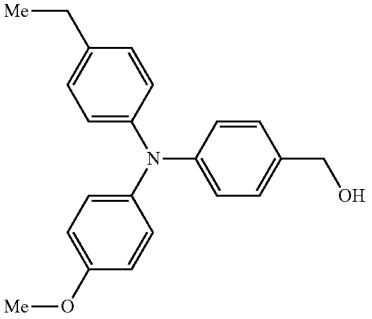
I-15
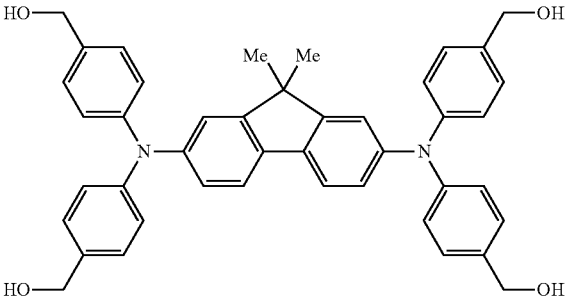
I-16
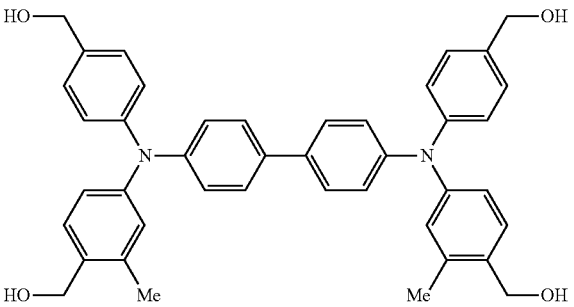

-continued
I-17
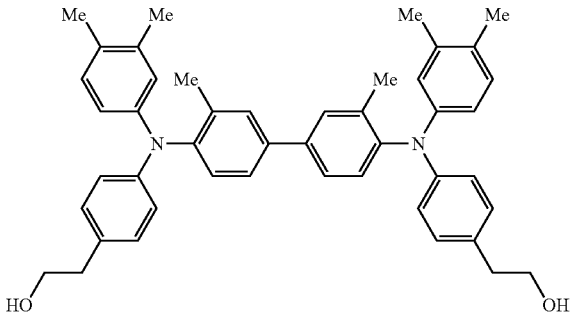
I-22
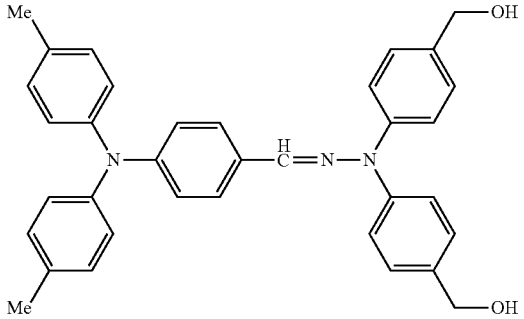
I-23
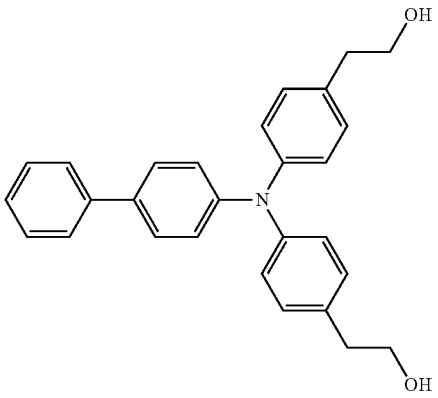
I-24
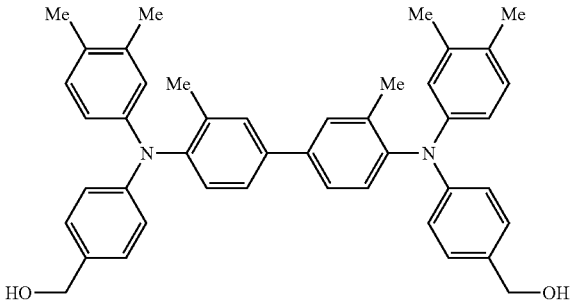
-continued
I-25
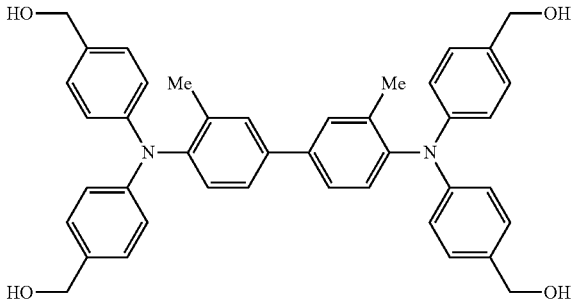
Herein, specific examples of the compound represented by Formula (I-2) include the following ones, but the compound is not limited thereto.
I-26
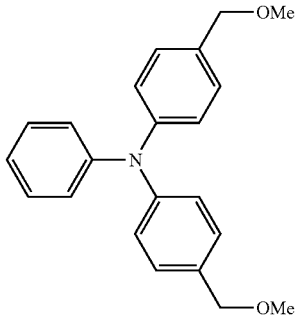
I-27
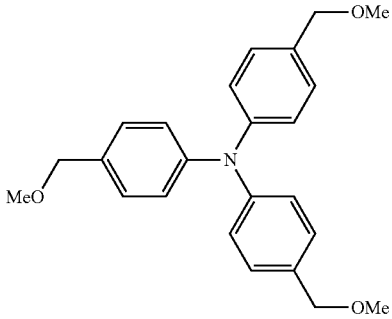
I-28
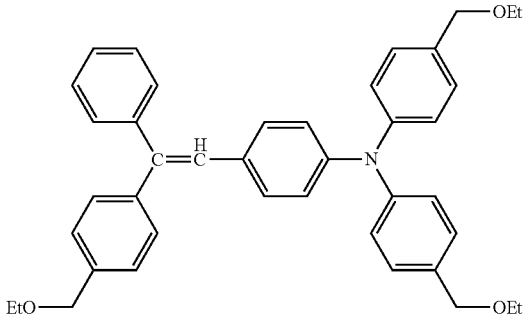

-continued
I-29
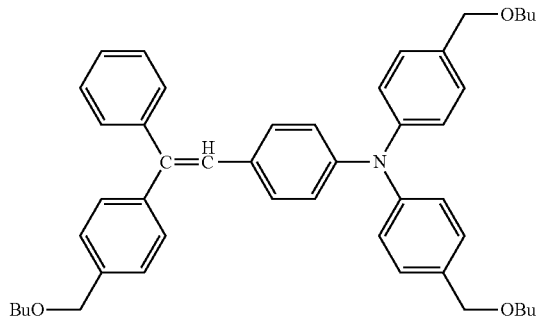
I-30
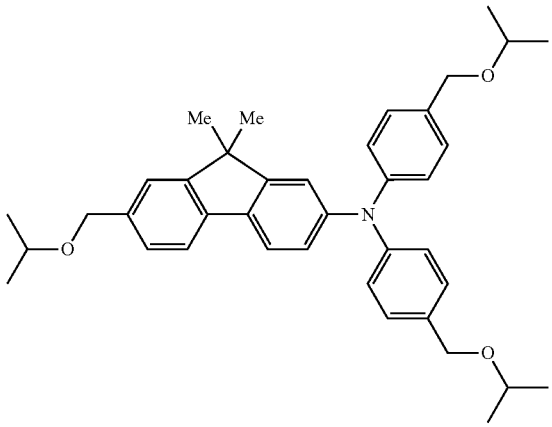
I-31
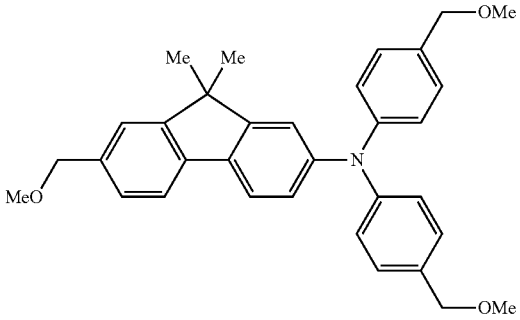
I-32
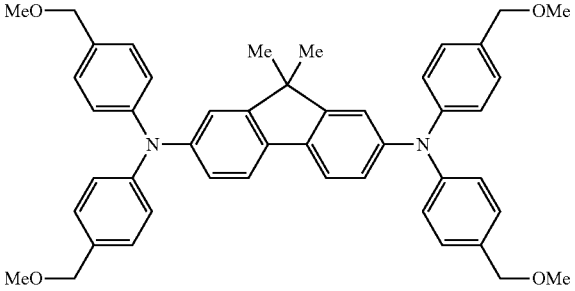
-continued
I-33
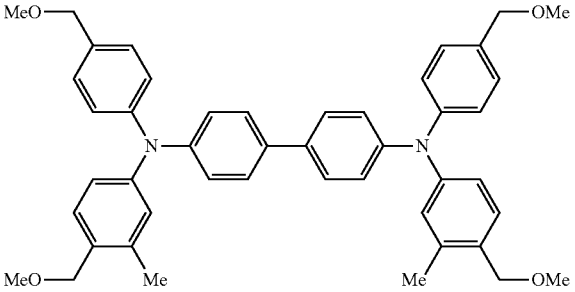
I-34
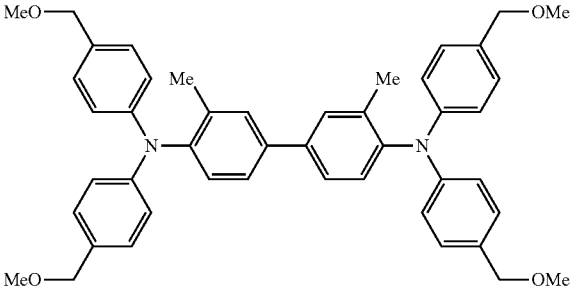
I-35
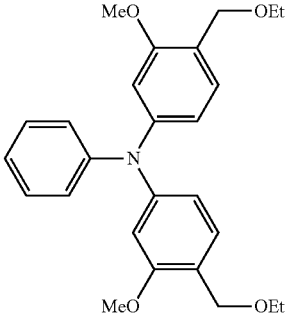
I-36
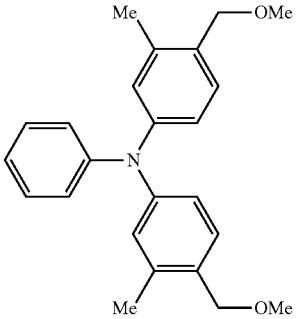
I-37
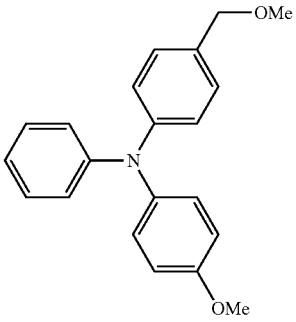

The mixing ratio (amount of (A)/amount of (B)) between the hydroxyl group-containing charge transport material (A) and the alkoxyl group-containing charge transport material (B) is desirably in a range of from 1/20 to 20/1, and more desirably in a range of from 10/1 to 2/1, in terms of a mass ratio.

Moreover, in addition to the compound represented by the Formulae (I-1) and (I-2), other charge transport materials having a reactive functional group may be concurrently used for the protective layer 2C. For example, at least one kind of the charge transport material having a structure represented by the following Formula (III) may be used concurrently.

$$F—((—R^1—X)_{n1}(R^2)_{n3}—Y)_{n2} \quad \text{(III)}$$

(In Formula (III), F represents an organic group derived from a compound having a hole transporting ability; each of $R^1$ and $R^2$ independently represents a linear or branched alkylene group having from 1 to 5 carbon atoms; n1 represents 0 or 1; n2 represents an integer of from 1 to 4; n3 represents 0 or 1; x represents any one selected from an oxygen group, a sulfur atom, and a —NH— group; and Y represents a $—NH_2$, —SH, or —COOH group.)

When other charge transport materials such as the Formula (III) are used concurrently, it is desirable to polymerize 90% by mass or more of all charge transport materials based on all monomers to be a solid content of the outermost surface layer (protective layer 2C in the first embodiment).

(Guanamine Compound)

The protective layer 2C formed by polymerizing the hydroxyl group-containing charge transport material (A) may also be formed by polymerizing the hydroxyl group-containing charge transport material (A) with at least one kind selected from guanamine compounds.

First, guanamine compounds will be described:

A guanamine compound is a compound having a guanamine skeleton (structure), and examples thereof include acetoguanamine, benzoguanamine, formoguanamine, steroguanamine, spiroguanamine, cyclohexylguanamine, and the like.

As a guanamine compound, at least one kind of a compound represented by the following Formula (A) and a multimer thereof is particularly desirable. Herein, the multimer is an oligomer obtained by polymerizing the compound represented by Formula (A) as a structural unit, and a polymerization degree thereof is, for example, from 2 to 200 (desirably from 2 to 100). The compound represented by Formula (A) may be used alone or in combination of two or more kinds thereof.

General Formula (A)

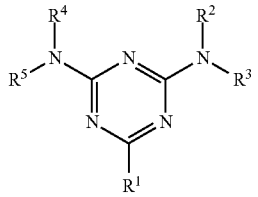

In Formula (A), $R^1$ represents an a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. Each of $R^2$ to $R^5$ independently represents hydrogen, $—CH_2—OH$, or $—CH_2—O—R^6$. $R^6$ represents hydrogen or a linear or branched alkyl group having from 1 to 10 carbon atoms.

In Formula (A), the alkyl group represented by $R^1$ has from 1 to 10 carbon atoms, desirably from 1 to 8 carbon atoms, and more desirably from 1 to 5 carbon atoms. The alkyl group may be linear or branched.

In Formula (A), the phenyl group represented by $R^1$ has from 6 to 10 carbon atoms, and more desirably from 6 to 8 carbon atoms. Examples of a substituent substituted on the phenyl group include a methyl group, an ethyl group, a propyl group, and the like.

In Formula (A), the alicyclic hydrocarbon group represented by $R^1$ has from 4 to 10 carbon atoms, and more desirably from 5 to 8 carbon atoms. Examples of a substituent substituted with the alicyclic hydrocarbon group include a methyl group, an ethyl group, a propyl group, and the like.

In Formula (A), the alkyl group represented by $R^6$ in "$—CH_2—O—R^6$" represented by $R^2$ to $R^5$ has from 1 to 10 carbon atoms, desirably from 1 to 8 carbon atoms, and more desirably from 1 to 6 carbon atoms. The alkyl group may be linear or branched, and desirable examples of the alkyl group include a methyl group, an ethyl group, a butyl group, and the like.

As the compound represented by Formula (A), a compound is particularly desirable in which $R^1$ represents a substituted or unsubstituted phenyl group having from 6 to 10 carbon atoms, and each of $R^2$ to $R^5$ independently represents $—CH_2—O—R^6$. In addition, $R^6$ is desirably selected from a methyl group and an n-butyl group.

The compound represented by Formula (A) is synthesized by a known method (see Experimental Chemistry Course, $4^{th}$ edition, Vol. 28, p. 430, for example) by using, for example, guanamine and formaldehyde.

Hereinafter, specific examples of the compound represented by Formula (A) will be shown, but the compound is not limited thereto. In the following specific examples, the compound is shown in the form of monomers, but the compound may be a multimer (oligomer) that has the monomers as structural units.

(A)-1

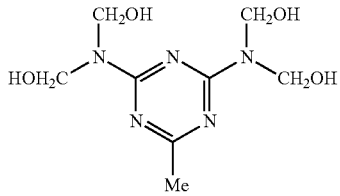

(A)-2

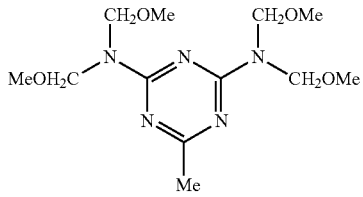

(A)-3

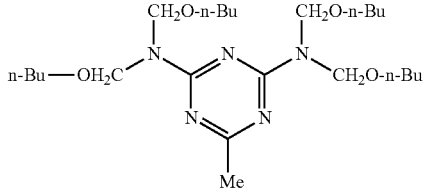

-continued
(A)-4
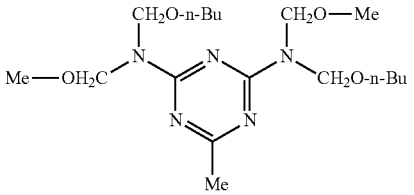
(A)-5
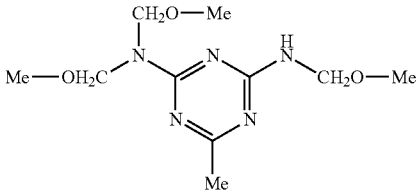
(A)-6
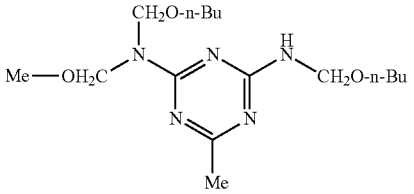
(A)-7
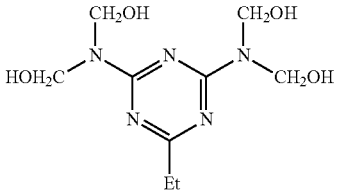
(A)-8
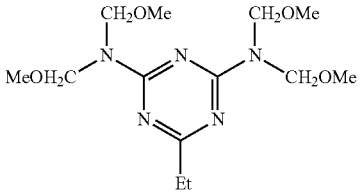
(A)-9
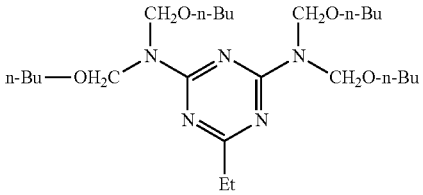
(A)-10
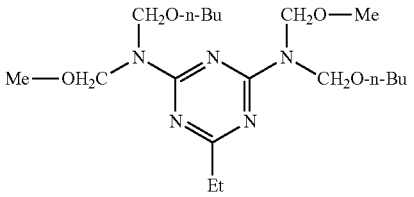
(A)-11
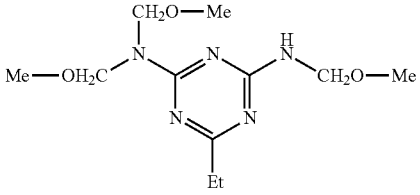
-continued
(A)-12
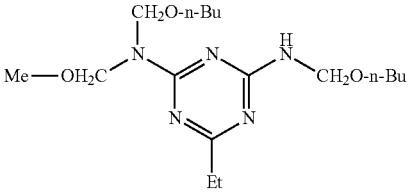
(A)-13
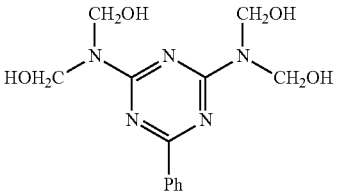
(A)-14
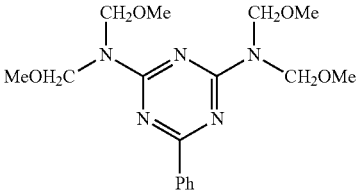
(A)-15
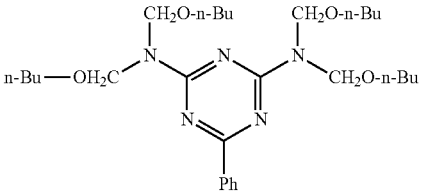
(A)-16
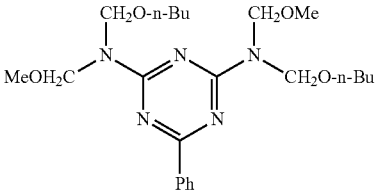
(A)-17
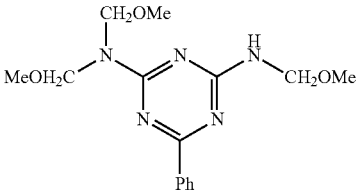
(A)-18
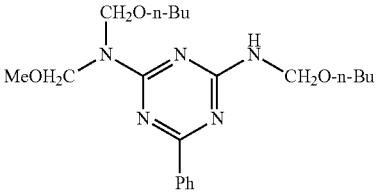

-continued
(A)-19
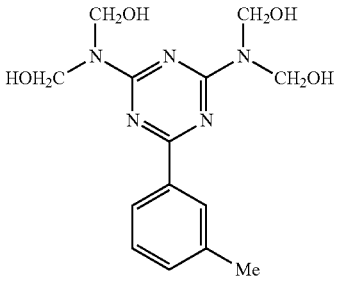
(A)-20
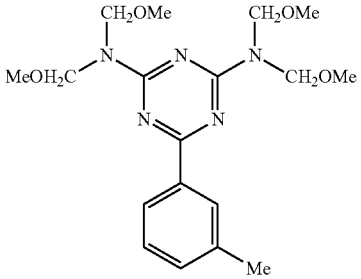
(A)-21
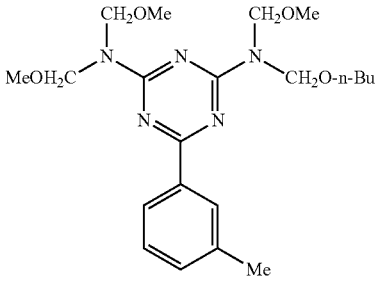
(A)-22
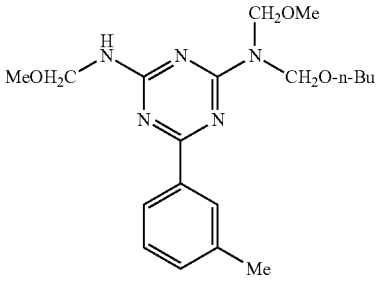
(A)-23
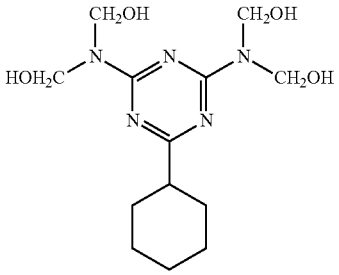
-continued
(A)-24
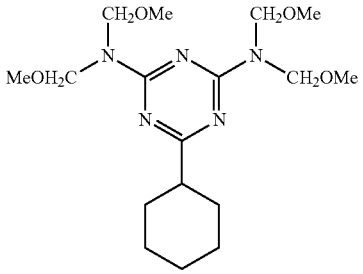
(A)-25
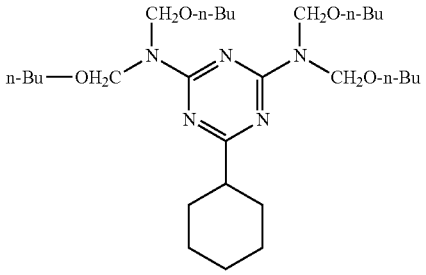
(A)-26
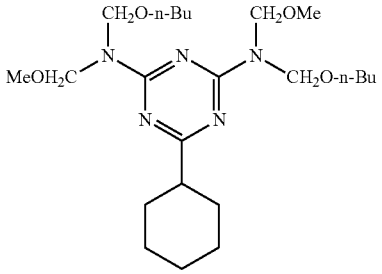
(A)-27
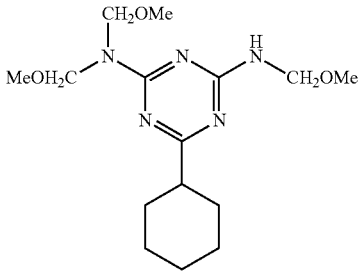
(A)-28
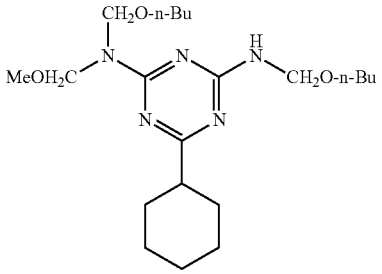

-continued
(A)-29
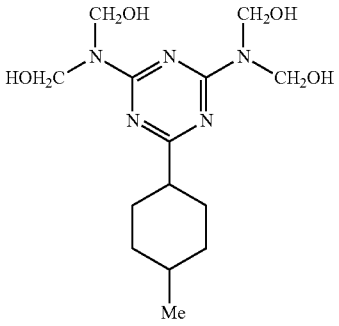
(A)-30
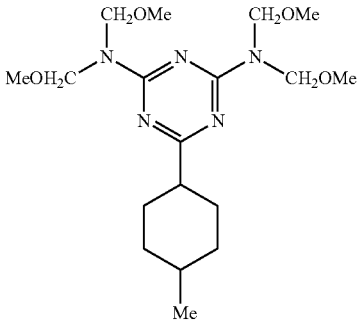
(A)-31
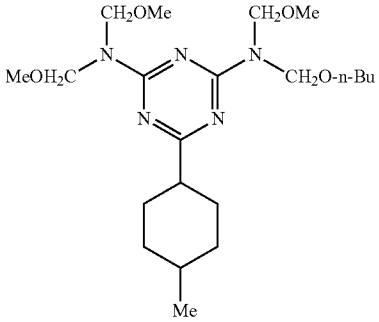
(A)-32
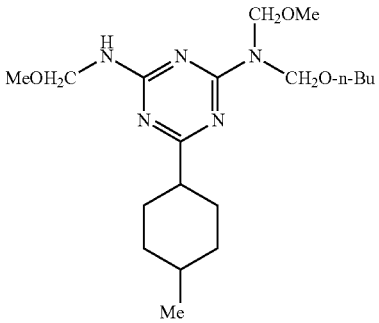
(A)-33
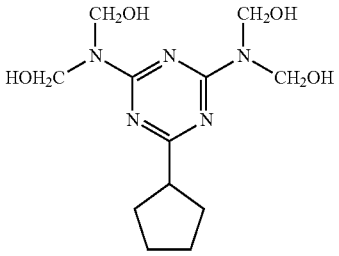
-continued
(A)-34
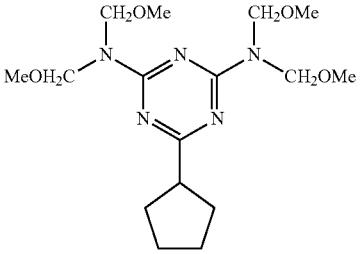
(A)-35
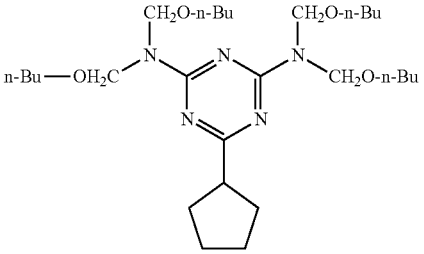
(A)-36
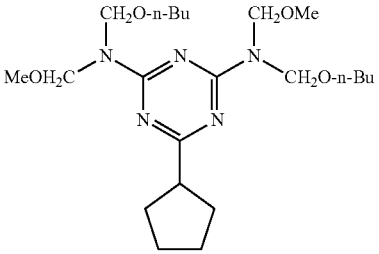
(A)-37
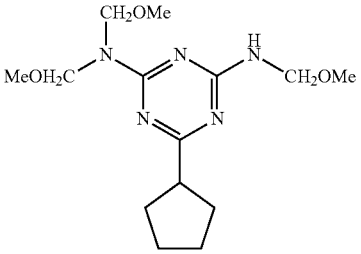
(A)-38
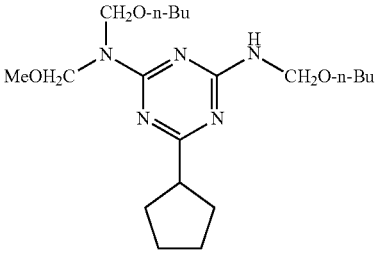
(A)-39
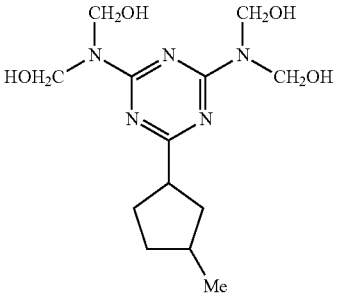

-continued (A)-40

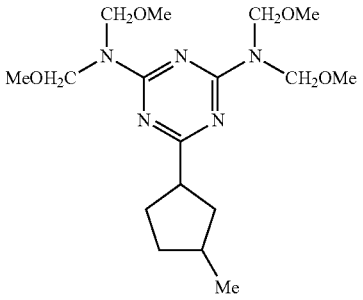

(A)-41

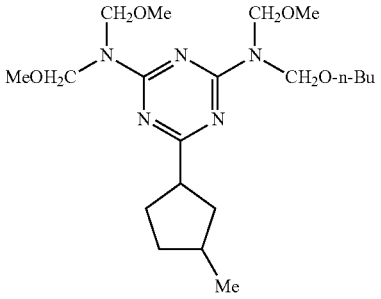

(A)-42

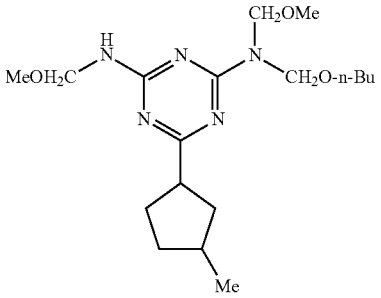

Examples of the commercially available products of the compound represented by Formula (A) include "Super Beckamine (R) L-148-55, Super Beckamine (R) 13-535, Super Beckamine (R) L-145-60, and Super Beckamine (R) TD-126" manufactured by DIC Corporation, "Nikalac BL-60 and Nikalac BX-4000" manufactured by NIPPON CARBIDE INDUSTRIES CO., INC., and the like.

After being synthesized or purchased as a commercially available product, the compound (containing a multimer) represented by Formula (A) may be dissolved in an appropriate solvent such as toluene, xylene, ethyl acetate, or the like and then washed with distilled water, ion exchange water, or the like, or may be treated with an ion exchange resin, so as to eliminate the influence of the residual catalyst.

Herein, the concentration of a solid content of at least one kind selected from guanamine compounds in a coating liquid for forming the outermost surface layer (protective layer 2C in the first embodiment) is desirably from 0.1% by mass to 5% by mass, and more desirably from 1% by mass to 3% by mass.

(Other Compositions)

In the protective layer 2C, other thermosetting resins such as a phenol resin, a xylene formaldehyde resin, a urea resin, an alkyd resin, and a benzoguanamine resin may be mixed in, in addition to a crosslinked substance formed by crosslinking of a specific charge transport material (crosslinkable charge transport material having an aromatic group and a —$CH_2OH$ group). Moreover, a compound that has a larger number of functional groups in a molecule, such as a spiroacetal-based guanamine resin (for example, "CTU-guanamine" (manufactured by Ajinomoto Fine-Techno Co., Inc.) may be copolymerized with the material in the crosslinked substance.

The protective layer 2C may contain fluorine-based resin particles. The fluorine-based resin particles are not particularly limited, but it is desirable to select one or two or more kinds from a polytetrafluoroethylene resin (PTFE), a trifluorochloroethylene resin, a pentafluoropropylene resin, a vinyl fluoride resin, a vinylidene fluoride resin, a difluorodichloroethylene resin, and a copolymer thereof. More desirable resins are a polytetrafluoroethylene resin and a vinylidene fluoride resin, and a polytetrafluoroethylene resin is particularly desirable.

The content of the fluorine-based resin particles based on the total solid content amount of the protective layer 2C as the outermost surface layer is desirably from 1% by mass to 30% by mass, and more desirably from 2% by mass to 20% by mass.

It is desirable to add a surfactant in the protective layer 2C. The surfactant used is not particularly limited as long as it includes one or more kinds of structures among a fluorine atom, an alkylene oxide structure, and a silicone structure, but the examples of the surfactant include those having plural structures described above.

Examples of the surfactant having a fluorine atom include various surfactants. Specific examples of the surfactant having a fluorine atom and an acryl structure include Polyflow KL600 (manufactured by KYOEISHA CHEMICAL Co., LTD), Eftop EF-351, EF-352, EF-801, EF-802, and EF-601 (manufactured by JEMCO, Inc.), and the like. Examples of the surfactant having an acryl structure include surfactants obtained by polymerizing or copolymerizing a monomer such as an acryl or methacryl compound.

Specific examples of the surfactant having a perfluoroalkyl group as a fluorine atom suitably include perfluoroalkyl sulfonic acids (for example, perfluorobutane sulfonic acid, perfluorooctane sulfonic acid, and the like), perfluoroalkyl carboxylic acids (for example, perfluorobutane carboxylic acid, perfluorooctane carboxylic acid, and the like), and perfluoroalkyl-containing phosphoric acid ester. The perfluoroalkyl sulfonic acids and the perfluoroalkyl carboxylic acids may be a salt thereof and an amide-modified product thereof.

Examples of commercially available products of the perfluoroalkyl sulfonic acids include Megafac F-114 (manufactured by DIC Corporation), Eftop EF-101, EF-102, EF-103, EF-104, EF-105, EF-112, EF-121, EF-122A, EF-122B, EF-122C, and EF-123A (manufactured by JEMCO, Inc.), A-K, 501 (manufactured by NEOS COMPANY LIMITED), and the like.

Examples of the commercially available products of the perfluoroalkyl carboxylic acids include Megafac F-410 (manufactured by DIC Corporation), Eftop EF-201 and EF-204 (manufactured by JEMCO, Inc.), and the like.

Examples of the commercially available products of the perfluoroalkyl-containing phosphoric acid ester include Megafac F-493 and F-494 (manufactured by DIC Corporation), Eftop EF-123A, EF-123B, EF-125M, and EF-132 (manufactured by JEMCO, Inc.), and the like.

Examples of surfactants having an alkylene oxide structure include polyethylene glycol, a polyether antifoam agent, polyether-modified silicone oil, and the like. The number average molecular weight of polyethylene glycol is desirably 2000 or less. Examples of the polyethylene glycol having a number average molecular weight of 2000 or less include polyethylene glycol 2000 (number average molecular weight of 2000), polyethylene glycol 600 (number average molecular weight of 600), polyethylene glycol 400 (number average molecular weight of 400), polyethylene glycol 200 (number average molecular weight of 200), and the like.

Examples of the polyether antifoam agent include PE-M and PE-L (manufactured by Wako Pure Chemical Industries, Ltd.), antifoam agents No. 1 and No. 5 (manufactured by Kao Corporation), and the like.

Examples of the surfactant having a silicone structure include general silicone oil such as dimethyl silicone, methylphenyl silicone, diphenyl silicone, and a derivative thereof.

Examples of the surfactant having both a fluorine atom and an alkylene oxide structure include a surfactant having an alkylene oxide structure or a polyalkylene structure in a side chain thereof, a surfactant in which the terminal of alkylene oxide or polyalkylene oxide structure has been substituted with a substituent containing fluorine, and the like. Specific examples of the surfactant having an alkylene oxide structure include Megafac F-443, F-444, F-445, and F-446 (manufactured by DIC Corporation), POLY FOX PF636, PF6320, PF6520, and PF656 (manufactured by KITAMURA CHEMICALS CO., LTD.), and the like.

Examples of the surfactant having both an alkylene oxide structure and a silicone structure include KF351 (A), KF352 (A), KF353 (A), KF354 (A), KF355 (A), KF615 (A), KF618, KF945 (A), and KF6004 (manufactured by Shin-Etsu Chemical Co., Ltd.), TSF4440, TSF4445, TSF4450, TSF4446, TSF4452, TSF4453, and TSF4460 (manufactured by GE Toshiba Silicones, Co., Ltd.), BYK-300, 302, 306, 307, 310, 315, 320, 322, 323, 325, 330, 331, 333, 337, 341, 344, 345, 346, 347, 348, 370, 375, 377, 378, UV3500, UV3510, and UV3570 (manufactured by BYK-Chemie Japan KK), and the like.

The content of the surfactant is desirably from 0.01% by mass to 1% by mass, and more desirably from 0.02% by mass to 0.5% by mass, based on the total solid content amount of the protective layer.

In the protective layer 2C, other coupling agents or fluorine compounds may be further mixed in. As the compound, various silane coupling agents and commercially available silicone-based hard coating agents may be used.

As the silane coupling agent, vinyl trichlorosilane, vinyl trimethoxysilane, vinyl triethoxysilane, γ-glycidoxypropyl methyl diethoxysilane, γ-glycidoxypropyl trimethoxysilane, γ-aminopropyl triethoxysilane, γ-aminopropyl trimethoxysilane, γ-aminopropyl methyl dimethoxysilane, N-β(aminoethyl) γ-aminopropyl triethoxysilane, tetramethoxysilane, methyl trimethoxysilane, dimethyl dimethoxysilane, and the like are used. As the commercially available hard coating agent, KP-85, X-40-9740, and X-8239 (manufactured by ShinEtsu Silicones); AY42-440, AY42-441, and AY49-208 (manufactured by Dow Corning Toray); and the like are used. In addition, in order to impart water repellency or the like, fluorine-containing compounds such as (tridecafluoro-1,1,2,2-tetrahydrooctyl)triethoxysilane, (3,3,3-trifluoropropyl)trimethoxysilane, 3-(heptafluoroisopropoxy)propyl triethoxysilane, 1H,1H,2H,2H-perfluoroalkyl triethoxysilane, 1H,1H,2H,2H-perfluorodecyl triethoxysilane, and 1H,1H,2H,2H-perfluoroctyl triethoxysilane may also be added. The silane coupling agent is used in an arbitrary amount, but the amount of the fluorine-containing compound is desirably 0.25 time or less of the compound not containing fluorine, based on mass.

A resin soluble in alcohol may be added to the protective layer. The resin soluble in alcohol herein refers to a resin that may be dissolved at 1% by mass or more in alcohol having 5 or less carbon atoms. Examples of the resin soluble in an alcohol-based solvent include a polyvinyl butyral resin, a polyvinyl formal resin, a polyvinyl acetal resin (for example S-LEK B, K, and the like manufactured by SEKISUI CHEMICAL CO., LTD.) such as a partially acetalized polyvinyl acetal resin obtained when a portion of butyral is modified with formal, acetoacetal, or the like, a polyamide resin, a cellulose resin, a polyvinyl phenol resin, and the like. Particularly, a polyvinyl acetal resin and a polyvinyl phenol resin are desirable.

The weight average molecular weight of the resin is desirably from 2,000 to 100,000, and more desirably from 5,000 to 50,000. In addition, the amount of the resin added is desirably from 1% by mass to 40% by mass, more desirably from 1% by mass to 30% by mass, and even more desirably from 5% by mass to 20% by mass.

An antioxidant may be added to the protective layer 2C. As the antioxidant, antioxidants based on hindered phenol or hindered amine are desirable, and known antioxidants such as an organic ion-based antioxidant, a phosphite-based antioxidant, a dithiocarbamic acid salt-based antioxidant, a thiourea-based antioxidant, and a benzimidazole-based antioxidant may also be used. The amount of the antioxidant added is desirably 20% by mass or less, and more desirably 10% by mass or less.

Examples of the hindered phenol-based antioxidant include 2,6-di-t-butyl-4-methylphenol, 2,5-di-t-butylhydroquinone, N,N'-hexamethylenebis(3,5-di-t-butyl-4-hydroxyhydrocinnamide, 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, 4,4'-butylidenebis(3-methyl-6-t-butylphenol), and the like.

Various particles may be added to the protective layer. An example of the particles includes silicon-containing particles. The silicon-containing particles are particles containing silicon as a constituent element, and specific examples thereof include colloidal silica and silicone particles. The colloidal silica used as the silicon-containing particles is selected from those obtained by dispersing silica having an average particle size of from 1 nm to 100 nm and desirably of from 10 nm to 30 nm in an organic solvent such as an acidic or alkaline aqueous dispersion, an alcohol, a ketone, or an ester, and commercially available general colloidal silica may also be used. The solid content of the colloidal silica in the protective layer 2C is not particularly limited, but the colloidal silica is used in a range of from 0.1% by mass to 50% by mass, and desirably in a range of from 0.1% by mass to 30% by mass, based on the total solid content amount of the protective layer.

The silicone particles used as the silicon-containing particles are selected from silicone resin particles, silicone rubber particles, and silica particles that are surface-treated with silicone, and commercially available general silicone particles are used as the silicone particles. These silicone particles are spherical, and the average particle size thereof is desirably from 1 nm to 500 nm, and more desirably from 10 nm to 100 nm. The silicone particles are chemically inactive and have excellent dispersibility with a resin. The content of the silicone particles in the protective layer is desirably from 0.1% by mass to 30% by mass, and more desirably from 0.5% by mass to 10% by mass, based on the total solid content amount of the protective layer.

Examples of other particles include fluorine-based particles such as tetrafluoroethylene, trifluoroethylene, hexafluoropropylene, vinyl fluoride, vinylidene fluoride; particles including a resin that is obtained by copolymerizing a fluororesin with a monomer having a hydroxyl group; and semiconductive metal oxides such as ZnO—$Al_2O_3$, $SnO_2$—$Sb_2O_3$, $In_2O_3$—$SnO_2$, $ZnO_2$—$TiO_2$, ZnO—$TiO_2$, MgO—$Al_2O_3$, FeO—$TiO_2$, $TiO_2$, $SnO_2$, $In_2O_3$, ZnO, and MgO.

In addition, oil such as silicone oil may be added to the protective layer. Examples of the silicone oil include silicone oil such as dimethyl polysiloxane, diphenyl polysiloxane, or phenyl methyl siloxane; reactive silicone oil such as amino-modified polysiloxane, epoxy-modified polysiloxane, carboxyl-modified polysiloxane, carbinol-modified polysiloxane, methacryl-modified polysiloxane, mercapto-modified polysiloxane, or phenol-modified polysiloxane; cyclic dimethyl cyclosiloxanes such as hexamethyl cyclotrisiloxane, octamethyl cyclotetrasiloxane, decamethyl cyclopentasiloxane, and dodecamethyl cyclohexasiloxane; cyclic methylphenyl cyclosiloxanes such as 1,3,5-trimethyl-1,3,5-triphenyl cyclotrisiloxane, 1,3,5,7-tetramethyl-1,3,5,7-tetraphenyl cyclotetrasiloxane, and 1,3,5,7,9-pentamethyl-1,3,5,7,9-pentaphenyl cyclopentasiloxane; cyclic phenyl cyclosiloxanes such as hexaphenyl cyclotrisiloxane; fluorine-containing cyclosiloxanes such as (3,3,3-trifluoropropyl) methyl cyclotrisiloxane; hydrosilyl group-containing cyclosiloxanes such as a methyl hydrosiloxane mixture, pentamethyl cyclopentasiloxane, and phenyl hydrocyclosiloxane; vinyl group-containing cyclosiloxanes such as pentavinyl pentamethyl cyclopentasiloxane; and the like.

A metal, metal oxide, carbon black, and the like may also be added to the protective layer. Examples of the metal include aluminum, zinc, copper, chromium, nickel, silver and stainless steel, or those obtained by vapor-depositing these metals onto the surface of plastic particles. Examples of the metal oxide include zinc oxide, titanium oxide, tin oxide, antimony oxide, indium oxide, bismuth oxide, indium oxide doped with tin, tin oxide doped with antimony or tantalum, zirconium oxide doped with antimony, and the like. These metal oxides may be used alone or in combination of two or more kinds thereof. When used in combination of two or more kinds thereof, the metal oxide may be simply mixed, or may be used in the form of a solid solution or may be melted. The average particle size of the conductive particles is 0.3 μm or less, and particularly desirably 0.1 μm or less.

The protective layer 2C may contain a curing catalyst for promoting curing of the guanamine compound and the specific charge transport material. As the curing catalyst, acid-based catalysts are desirably used. As the acid-based catalyst, aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; aliphatic and aromatic sulfonic acids such as methanesulfonic acid, dodecylsulfonic acid, benzenesulfonic acid, dodecylbenzenesulfonic acid, and naphthalenesulfonic acid; and the like are used. However, it is desirable to use sulfur-containing materials.

As the sulfur-containing material as the curing catalyst, materials showing acidity at room temperature (for example, 25° C.) or showing acidity after being heated are desirable. A most desirable material is at least one kind of organic sulfonic acid and a derivative thereof. The presence of those catalysts in the protective layer 2C is easily confirmed by Energy Dispersive X-Ray Spectroscopy (EDS), X-ray Photoelectron Spectroscopy (XPS), and the like.

Examples of the organic sulfonic acid and a derivative thereof include paratoluenesulfonic acid, dinonylnaphthalene sulfonic acid (DNNSA), dinonylnaphthalene disulfonic acid (DNNDSA), dodecylbenzene sulfonic acid, phenol sulfonic acid, and the like. Among these, paratoluenesulfonic acid and dodecylbenzene sulfonic acid are desirable. In addition, an organic sulfonic acid salt may also be used as long as this salt is able to be disassociated in a thermosetting resin composition.

Moreover, a so-called thermal latent catalyst of which the catalytic ability is heightened when heated may also be used.

Examples of the thermal latent catalyst include microcapsules packing an organic sulfone compound with polymers in a particle shape, a catalyst obtained by causing a porous compound such as zeolite to adsorb an acid or the like, a thermal latent protonic acid catalyst obtained by blocking a protonic acid or a protonic acid derivative with a base, a catalyst obtained by estrifying a protonic acid or a protonic acid derivative with a primary or secondary alcohol, a catalyst obtained by blocking a protonic acid or a protonic acid derivative with vinyl ethers or vinyl thioethers, a monoethylamine complex of boron trifluoride, a pyridine complex of boron trifluoride, and the like.

Among these, the catalyst obtained by blocking a protonic acid or a protonic acid derivative with a base is desirable.

Examples of the protonic acid of the thermal latent protonic acid catalyst include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzenesulfonic acid, o,m,p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, dodecybenzenesulfonic acid, and the like. Examples of the protonic acid derivative include neutralized products such as an alkali metal salt or an alkali earth metal salt of a protonic acid including sulfonic acid and phosphoric acid; polymeric compounds (such as polyvinyl sulfonic acid) obtained by introducing a protonic acid skeleton to a polymer chain; and the like. Examples of the base blocking protonic acid include amines.

Amines are classified into primary, secondary, and tertiary amine, and any amine may be used without particular limitation.

Examples of primary amine include methylamine, ethylamine, propylamine, isopropylamine, n-butylamine, isobutylamine, t-butylamine, hexylamine, 2-ethylhexylamine, sec-butylamine, allylamine, methylhexylamine, and the like.

Examples of secondary amine include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di-sec-butylamine, diallylamine, N-methylhexylamine, 3-pipecoline, 4-pipecoline, 2,4-lupetidine, 2,6-lupetidine, 3,5-lupetidine, morpholine, N-methylbenzylamine, and the like.

Examples of tertiary amine include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-colidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, N-methylpiperazine, and the like.

Examples of commercially available products of the thermal latent catalyst include "NACURE 2501" (toluenesulfonic acid dissociation, a methanol/isopropanol solvent, pH of from 6.0 to 7.2, dissociation temperature of 80° C.), "NACURE 2107" (p-toluenesulfonic acid dissociation, an isopropanol solvent, pH of from 8.0 to 9.0, dissociation temperature of 90° C.), "NACURE 2500" (p-toluenesulfonic acid dissociation, an isopropanol solvent, pH of from 6.0 to 7.0, dissociation temperature of 65° C.), "NACURE 2530" (p-toluenesulfonic acid dissociation, a methanol/isopropanol solvent, pH of from 5.7 to 6.5, dissociation temperature of 65° C.), "NACURE 2547" (p-toluenesulfonic acid dissociation, an aqueous solution, pH of from 8.0 to 9.0, dissociation temperature of 107° C.), "NACURE 2558" (p-toluenesulfonic acid dissociation, an ethylene glycol solvent, pH of from 3.5 to 4.5, dissociation temperature of 80° C.), "NACUREXP-357" (p-toluenesulfonic acid dissociation, a methanol solvent, pH of from 2.0 to 4.0, dissociation temperature of 65° C.), "NACUREXP-386" (p-toluenesulfonic acid dissociation, an aqueous solution, pH of from 6.1 to 6.4, dissociation temperature of 80° C.), "NACUREXC-2211" (p-toluenesulfonic acid dissociation, pH of from 7.2 to 8.5, dissociation temperature of 80° C.), "NACURE 5225" (dodecylbenzenesulfonic acid dissociation, an isopropanol solvent, pH of from 6.0 to 7.0, dissociation temperature of 120° C.), "NACURE 5414" (dodecylbenzenesulfonic acid dissociation, a xylene solvent, dissociation temperature of 120° C.), "NACURE 5528" (dodecylbenzenesulfonic acid dissociation, an isopropanol solvent, pH of from 7.0 to 8.0, dissociation temperature of 120° C.), "NACURE 5925" (dodecylbenzenesulfonic acid dissociation, pH of from 7.0 to 7.5, dissociation temperature of 130° C.), "NACURE 1323" (dinonylnaphthalenesulfonic acid dissociation, a xylene solvent, pH of from 6.8 to 7.5, dissociation temperature of 150° C.), "NACURE 1419" (dinonylnaphthalenesulfonic acid dissociation, a xylene/methyl isobutyl ketone solvent, dissociation temperature of 150° C.), "NACURE 1557" (dinonylnaphthalenesulfonic acid dissociation, a butanol/2-butoxyethanol solvent, pH of from 6.5 to 7.5, dissociation temperature of 150° C.), "NACUREX49-110" (dinonylnaphthalenedisulfonic acid dissociation, an isobutanol/isopropanol solvent, pH of from 6.5 to 7.5, dissociation temperature of 90° C.), "NACURE 3525" (dinonylnaphthalenedisulfonic acid dissociation, an isobutanol/isopropanol solvent, pH of from 7.0 to 8.5, dissociation temperature of 120° C.), "NACUREXP-383" (dinonylnaphthalenedisulfonic acid dissociation, a xylene solvent, dissociation temperature of 120° C.), "NACURE 3327" (dinonylnaphthalenedisulfonic acid dissociation, an isobutanol/isopropanol solvent, pH of from 6.5 to 7.5, dissociation temperature of 150° C.), "NACURE 4167" (phosphoric acid dissociation, an isopropanol/isobutanol solvent, pH of from 6.8 to 7.3, dissociation temperature of 80° C.), "NACUREXP-297" (phosphoric acid dissociation, a water/isopropanol solvent, pH of from 6.5 to 7.5, dissociation temperature of 90° C.), "NACURE 4575" (phosphoric acid dissociation, pH of from 7.0 to 8.0, dissociation temperature of 110° C.) (all manufactured by King Industries, Inc.), and the like.

These thermal latent catalysts may be used alone or in combination of two or more kinds thereof.

Herein, the amount of the catalyst mixed in is desirably in a range of from 0.1% by mass to 10% by mass, and particularly desirably in a range of from 0.1% by mass to 5% by mass, based on total solid contents in the coating liquid excluding fluorine-based resin particles and an alkyl fluoride group-containing copolymer.

(Method of Forming Outermost Surface Layer)

Herein, as an example of a process for forming the outermost surface layer in producing the photoreceptor of the exemplary embodiment, a method of forming the protective layer 2C which is the outermost surface layer in the photoreceptor of the first embodiment will be described.

First, the method of forming the photoreceptor of the first embodiment includes preparing a conductive substrate for preparing the conductive substrate 1 in which layers (that is, the undercoat layer 4, the charge generating layer 2A, the charge transporting layer 2B, and the like) other than an outermost surface layer (that is, protective layer 2C) are formed; and forming an outermost surface layer for forming an outermost surface layer (that is, protective layer 2C) by coating a coating liquid that contains the specific charge transport material and other compositions onto the conductive substrate and polymerizing the resultant.

The forming step of an outermost surface layer desirably includes coating and polymerizing, wherein the coating includes coating a coating liquid that contains a crosslinkable charge transport material having an aromatic group and a —$CH_2OH$ group onto a conductive substrate, and the polymerizing includes polymerizing the crosslinkable charge transport material by heating at about 160° C. or a lower temperature within about 40 minutes in a nitrogen atmosphere.

As described above, in view of controlling the value of (Peak 2)/(Peak 1) within the above-described range, the crosslinkable charge transport material (specific charge transport material) having an aromatic group and a —$CH_2OH$ group is desirably polymerized by being heated in a nitrogen atmosphere. Moreover, the condition of the curing (or heating) temperature and curing (or heating) time is desirably set to a mild condition. The curing temperature and time are desirably set to 160° C. or lower (or about 160° C. or lower) and within 40 minutes (or about 40 minutes) respectively. Here, in view of effectively reacting a hydroxyl group, the curing temperature and time are desirably set to 120° C. or higher (or about 120° C. or higher) and 20 minutes or longer (or about 20 minutes or longer) respectively.

More preferably, heating is performed at from 135° C. to 155° C. (or from about 135° C. to about 155° C.) for from 20 minutes to 35 minutes (or from about 20 minutes to about 35 minutes), and particularly from 135° C. to 150° C. (or from about 135° C. to about 150° C.) for from 20 minutes to 35 minutes (or from about 20 minutes to about 35 minutes).

Examples of the solvent used for forming the protective layer 2C as the outermost surface layer include solvents such as a cyclic aliphatic ketone compound such as cyclobutanone, cyclopentanone, cyclohexanone, or cycloheptanone; cyclic or linear alcohols such as methanol, ethanol, propanol, butanol, and cyclopentanol; linear ketones such as acetone and methyl ethyl ketone; cyclic or linear ethers such as tetrahydrofuran, dioxane, ethylene glycol, and diethyl ether; and a halogenated aliphatic hydrocarbon solvent such as methylene chloride, chloroform, or ethylene chloride.

Examples of the method of coating a coating liquid for forming a coat that is used for forming the protective layer 2C as the outermost surface layer include methods such as die coating, ring coating, blade coating, wire bar coating, spray coating, dip coating, bead coating, air knife coating, curtain coating, and ink jet coating.

The thickness of the outermost surface layer in the exemplary embodiment is desirably from 5 μm to 20 μm, and more desirably from 7 μm to 15 μm.

[Photoreceptor of Second Embodiment: Outermost Surface Layer=Charge Transporting Layer]

As shown in FIG. 2, the photoreceptor of the second embodiment as an example in the exemplary embodiment has a layer configuration in which the undercoat layer 4, the charge generating layer 2A, and the charge transporting layer 2B are layered on the conductive substrate 1 in this order. In this photoreceptor, the charge transporting layer 2B is an outermost surface layer.

As the conductive substrate 1, undercoat layer 4, and the charge generating layer 2A in the photoreceptor of the second embodiment, the conductive substrate 1, the undercoat layer 4, and the charge generating layer 2A in the photoreceptor of the first embodiment shown in FIG. 1 are applied as they are. In addition, as the charge transporting layer 23 in the photoreceptor of the second embodiment, the protective layer 2C in the photoreceptor of the first embodiment shown in FIG. 1 is applied as it is.

[Image Forming Apparatus and Process Cartridge]

An image forming apparatus according to the exemplary embodiment of the invention includes the electrophotographic photoreceptor according to the exemplary embodiment, a charging device that charges the electrophotographic photoreceptor, an exposure device that exposes the charged electrophotographic photoreceptor to form an electrostatic latent image, a developing device that develops the electrostatic latent image with a toner to form a toner image, and a transfer device that transfers the toner image from the electrophotographic photoreceptor to a recording medium.

Further, a process cartridge according to the exemplary embodiment of the invention includes the electrophotographic photoreceptor according to the exemplary embodiment, and at least one device selected from a group consisting of a charging device that charges the electrophotographic photoreceptor, an exposure device that exposes the charged electrophotographic photoreceptor to form an electrostatic latent image, a developing device that develops the electrostatic latent image with a toner to forms a toner image, and a cleaning device that removes a residual toner on the surface of the electrophotographic photoreceptor.

Figure 3:
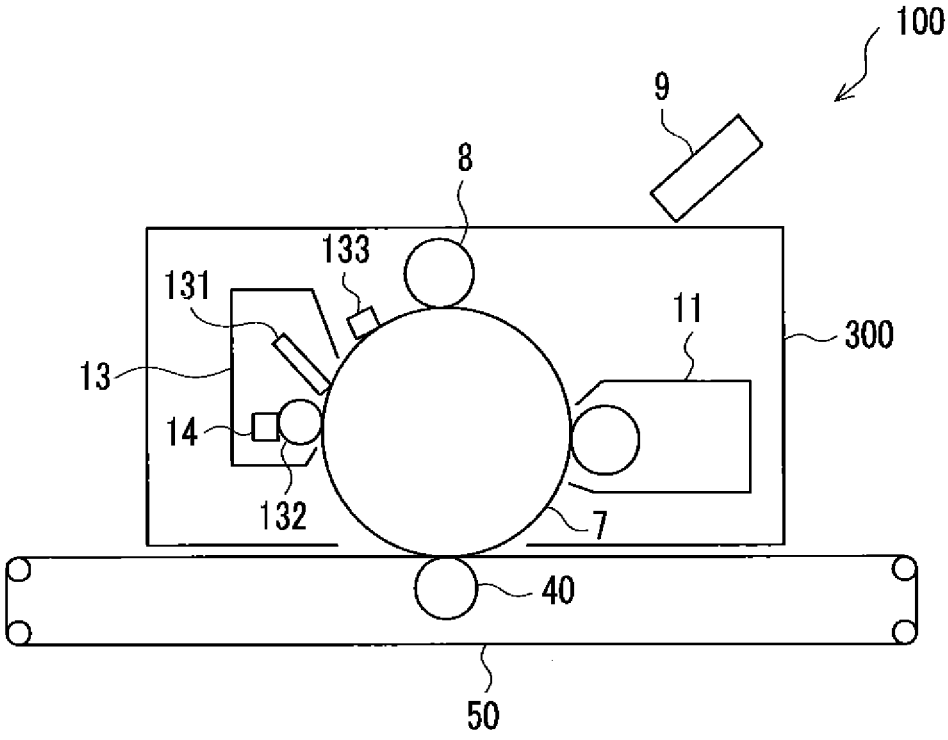
FIG. 3 is a schematic configuration view showing an image forming apparatus according to the exemplary embodiment.

FIG. 3 is a schematic configuration view showing an image forming apparatus according to the exemplary embodiment. As shown in FIG. 3, an image forming apparatus 100 includes a process cartridge 300 having an electrophotographic photoreceptor 7, an exposure device 9, a transfer device 40, and an intermediate transfer member 50. In the image forming apparatus 100, the exposure device 9 is disposed in a position for exposing the electrophotographic photoreceptor 7 through an opening portion of the process cartridge 300, the transfer device 40 is disposed in a position where the transfer device 40 faces the electrophotographic photoreceptor 7 across the intermediate transfer member 50, and the intermediate transfer member 50 is disposed while bringing a portion thereof into contact with the electrophotographic photoreceptor 7.

The process cartridge 300 in FIG. 3 integrally supports the electrophotographic photoreceptor 7, a charging device 8, a developing device 11, and a cleaning device 13 inside a housing. A cleaning device 13 has a cleaning blade 131 (blade member) formed of an elastic material such as rubber. The cleaning blade 131 is disposed such that an end thereof contacts the surface of the electrophotographic photoreceptor 7 and uses a method of removing developer such as a toner attached to the surface of the electrophotographic photoreceptor 7. In addition to this method, a known cleaning method such as a method of using a cleaning brush that uses a conductive plastic is used.

FIG. 3 shows an example that uses a fibrous member 132 (roll shape) supplying a lubricant 14 to the surface of the photoreceptor 7 and a fibrous member 133 (flat brush shape) assisting cleaning, but these members may be optionally used.

As the charging device 8, for example, a contact type charging device using a conductive or semiconductive charging roll, a charging brush, a charging film, a charging rubber blade, a charging tube, or the like is used. In addition, known charging devices such as a non-contact type of roll charging device, a scorotron charging device using corona discharge, and a corotron charging device may also be used.

Though not shown in the drawing, a photoreceptor heating member for increasing the temperature of the electrophotographic photoreceptor 7 and reducing a relative temperature is provided around the electrophotographic photoreceptor 7 so as to improve the image stability.

Examples of the exposure device 9 include an optical system instrument or the like that exposes a desired image with light such as a semiconductor laser beam, LED light, or liquid crystal shutter light on the surface of the photoreceptor 7. As the wavelength of a light source, wavelengths in a spectral sensitivity region of the photoreceptor are used. As the wavelength of the semiconductor laser, near infrared radiation having an oscillation wavelength near 780 nm is used in most cases. However, the wavelength is not limited thereto, and lasers such as a laser having an oscillation wavelength of about 600 nm and a blue laser having an oscillation wavelength of from 400 nm to 450 nm may also be used. In addition, in order to form multi-color images, a surface-emitting type of laser beam source which realizes multi-beam output is also effective.

As the developing device 11, for example, a general developing device may be used which performs developing by carrying a developer into contact with the photoreceptor. The developer contains a magnetic single-component developer or non-magnetic single-component developer or two-component developer. The developing device is not limited as long as it has the function described above, and is selected according to purposes. For example, a known developing device or the like is used which has a function of attaching the single-component developer or two-component developer to the photoreceptor 7 by using a brush, a roll, or the like. Among these, it is desirable to use a developing roll holding the developer on the surface thereof.

Hereinafter, a toner used for the developing device 11 will be described.

The average shape factor $((ML^2/A)\times(\pi/4)\times100$, ML herein represents a maximum length of particles, and A represents a projected area of the particles) of the toner used in the image forming apparatus according to the exemplary embodiment is preferably from 100 to 150, more preferably from 105 to 145, and even more preferably from 110 to 140. The volume average particle size of the toner is preferably from 3 μm to 12 μm, and even more preferably from 3.5 μm to 9 μm.

The toner is not particularly limited in terms of the production method. For example, a toner is used which is produced by a kneading and pulverizing method that kneads, pulverizes, and classifies a binder resin, a colorant, a release agent, and a charge control agent; a method that changes the shape of the particles obtained by the kneading and pulverizing method by using mechanical impact or heat energy; an emulsion polymerization aggregation method in which polymerizable monomers of a binder resin are emulsion-polymerized to form a dispersion, the dispersion is mixed with a colorant, a release agent, and with a dispersion of a charge control agent or the like, followed by aggregation and heat melting, thereby obtaining toner particles; a suspension polymerization method in which polymerizable monomers for obtaining a binder resin, a colorant, a release agent, and a solution of a charge control agent or the like are suspended in an aqueous solvent, followed by polymerization; a dissolution suspension method in which a binder resin, a colorant, a release agent, and a solution of a charge control agent are suspended in an aqueous solvent to produce particles; or the like.

In addition, a known method such as a method of creating a core shell structure by further attaching aggregated particles to the toner as a core obtained by the above-described method and performing heat melting may be used. As the method of producing a toner, the suspension polymerization method producing a toner by using an aqueous solvent, the emulsion polymerization aggregation method, and the dissolution suspension method are desirable, and particularly, the emulsion polymerization aggregation method is desirable, in view of controlling a shape and particle size distribution.

The toner mother particles desirably contain a binder resin, a colorant, and a release agent, and may further contain silica or the charge control agent.

Examples of the binder resin used for the toner mother particles contain homopolymers or copolymers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and polyester resins obtained by copolymerizing dicarboxylic acids with dials; and the like.

Particularly, examples of typical binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, a polyester resin, and the like. The examples further include polyurethane, an epoxy resin, a silicone resin, polyamide, modified rosin, paraffin wax, and the like.

Examples of typical colorants include magnetic powders of magnetite, ferrite, or the like, carbon black, aniline blue, calcoil blue, chrome yellow, ultramarine blue, Dupont oil red, quinoline yellow, methylene blue chloride, phthalocyanine blue, malachite green oxalate, lamp black, rose Bengal, C. I. pigment red 48:1, C. I. pigment red 122, C. I. pigment red 57:1, C. I. pigment yellow 97, C. I. pigment yellow 17, C. I. pigment blue 15:1, C. I. pigment blue 15:3, and the like.

Examples of typical release agents include low-molecular weight polyethylene, low-molecular weight polypropylene, Fischer-Tropsch wax, montan wax, carnauba wax, rice wax, candelilla wax, and the like.

As the charge control agent, known agents are used, and an azo-based metal complex compound, a metal complex compound of salicylic acid, and a resin type charge control agent containing a polar group may be used. When the toner is produced by a wet production method, it is desirable to use a material that is not easily dissolved in water. In addition, the toner may be either a magnetic toner containing a magnetic material or a non-magnetic toner not containing a magnetic material.

The toner used for the developing device 11 is produced by mixing the toner mother particles with the additives described above by using a Henschel mixer or a V blender. When the toner mother particles are produced through a wet method, the particles may be externally added through the wet method.

Lubricant particles may be added to the toner. As the lubricant particles, solid lubricants such as graphite, molybdenum disulfide, talc, fatty acids, and fatty acid metal salts; low-molecular weight polyolefins such as polypropylene, polyethylene, and polybutene; silicones having a softening point by heating; aliphatic amides such as oleic acid amide, erucic acid amide, ricinoleic acid amide, and stearic acid amide; plant waxes such as carnauba wax, rice wax, candelilla wax, Japanese wax, and jojoba oil; animal wax such as beeswax; mineral and petroleum waxes such as montan wax, ozokerite, ceresin, paraffin wax, micro-crystalline wax, and Fischer-Tropsch wax; and a modified product thereof are used. These may be used alone or in combination of two or more kinds thereof. Here, the average particle size thereof is desirably in a range of from 0.1 μm to 10 μm, and the particle size may be obtained by pulverizing particles having the chemical structure described above. The amount of the lubricant particles added to the toner is desirably in a range of from 0.05% by mass to 2.0% by mass, and more desirably in a range of from 0.1% by mass to 1.5% by mass.

Inorganic particles, organic particles, complex particles which are obtained by attaching inorganic particles to the organic particles, and the like may be added to the toner used for the developing device 11.

As the inorganic particles, various inorganic oxides, nitrides, and borides such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride are suitably used.

The inorganic particles may be treated with titanium coupling agents such as tetrabutyl titanate, tetraoctyl titanate, isopropyl triisostearoyl titanate, isopropyl tridecyl benzenesulfonyl titanate, and bis(dioctylpyrophosphate)oxyacetate titanate; and silane coupling agents such as γ-(2-aminoethyl) aminopropyl trimethoxysilane, γ-(2-aminoethyl)aminopropyl methyl dimethoxysilane, γ-methacryloxypropyl trimethoxysilane, an N-β-(N-vinylbenzylaminoethyl)γ-aminopropyl trimethoxysilane hydrochloric acid salt, hexamethyldisilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane, and p-methylphenyl trimethoxysilane. In addition, inorganic particles treated to be hydrophobic by using higher fatty acid metal salts such as silicone oil, aluminum stearate, zinc stearate, and calcium stearate are also desirably used.

Examples of the organic particles include styrene resin particles, styrene acrylic resin particles, polyester resin particles, urethane resin particles, and the like.

The size of the particles used is desirably from 5 nm to 1000 nm, more desirably from 5 nm to 800 nm, and even more desirably from 5 nm to 700 nm, in terms of a number average particle size. The sum of the added amount of particles and lubricant particles described above is desirably 0.6% by mass or more.

As other inorganic oxides added to the toner, small size inorganic oxides having a primary particle size of 40 nm or less are used. It is desirable to further add inorganic oxides larger than the above oxides. Known oxides may be used as the inorganic oxides particles, but it is desirable to concurrently use silica and titanium oxide.

The small size inorganic particles may be surface-treated. In addition, adding carbonate such as calcium carbonate or magnesium carbonate or inorganic mineral such as hydrotalcite is also desirable.

The color toner for electrophotography is used by being mixed with a carrier, and as the carrier, iron powder, glass beads, ferrite powder, nickel powder, or a substance obtained by coating a resin onto the surface of the carrier is used. The mixing ratio between the color toner and the carrier is set according to necessity.

Examples of the transfer device 40 include known transfer charging devices such as a contact-type transfer charging device using a belt, a roll, a film, a rubber blade, or the like, a scorotron transfer charging device using corona discharge, and a corotron transfer charging device.

As the intermediate transfer member 50, semi conductivity-imparted polyimide, polyamideimide, polycarbonate, polyarylate, polyester, or rubber, which is shaped like a belt (intermediate transfer belt), is used. In addition, as an embodiment of the intermediate transfer member 50, a drum-like member is also used in addition to the belt-like member.

The image forming apparatus 100 may include, for example, an optical erasing device that performs optical erasing on the photoreceptor 7, in addition to the above-described respective devices.

Figure 4:
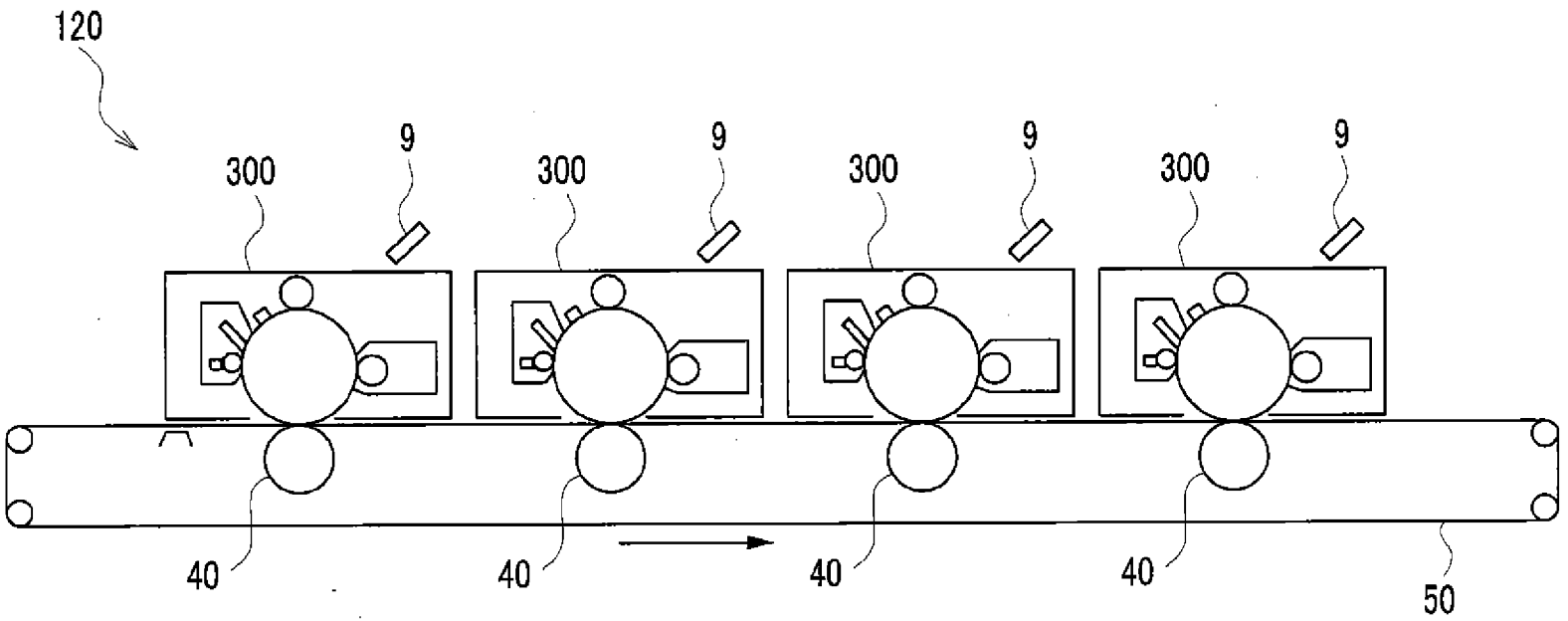
FIG. 4 is a schematic configuration view showing another image forming apparatus according to the exemplary embodiment.

FIG. 4 is a schematic cross-sectional view showing an image forming apparatus according to another exemplary embodiment. As shown in FIG. 4, an image forming apparatus 120 is a tandem type multi-color image forming apparatus on which four process cartridges 300 are mounted. The image forming apparatus 120 has a configuration in which the four process cartridges 300 are arranged on the intermediate transfer member 50 in parallel, and one electrophotographic photoreceptor is used for a color. The image forming apparatus 120 has the same configuration as that of the image forming apparatus 100, except that the image forming apparatus 120 is a tandem type apparatus.

EXAMPLES

Hereinafter, the exemplary embodiment of the invention will be described in detail based on examples and comparative examples, but the exemplary embodiment of the invention is not limited to the following examples.

Example 1

An electrophotographic photoreceptor is prepared in the following method.

(Preparation of Undercoat Layer)

100 parts by mass of zinc oxide (average particle size of 70 nm: manufactured by TAYCA: specific surface area of 15 $m^2/g$) is mixed with 500 parts by mass of tetrahydrofuran under stirring, and 1.0 part by mass of a silane coupling agent (KEB502: manufactured by Shin-Etsu Chemical Co., Ltd.) is added thereto, followed by stirring for 2 hours. Thereafter, toluene is distilled away through distillation under reduced pressure, and the resultant is baked at 125° C. for 3 hours, thereby obtaining zinc oxide that has been surface-treated with the silane coupling agent.

105 parts by mass of the surface-treated zinc oxide is mixed with 500 parts by mass of tetrahydrofuran under stirring, and a solution obtained by dissolving 0.4 parts by mass of alizarin in 90 parts by mass of tetrahydrofuran is added thereto, followed by stirring at 50° C. for 4 hours. Thereafter, the alizarin-attached zinc oxide is filtered by filtration under reduced pressure, followed by drying at 60° C. under reduced pressure, thereby obtaining the alizarin-attached zinc oxide.

38 parts by mass of a solution obtained by dissolving 60 parts by mass of the alizarin-attached zinc oxide, 14 parts by mass of a curing agent (blocked isocyanate Sumidur BL 3175, manufactured by Sumika Bayer Urethane Co., Ltd.), and 15 parts by mass of a butyral resin (S-LEK BM-1, manufactured by SEKISUI CHEMICAL CO., LTD.) in 85 parts by mass of methyl ethyl ketone is mixed with 30 parts by mass of methyl ethyl ketone, and the resultant is dispersed with a sand mill for 1.5 hours by using 1 mmϕ glass beads, thereby obtaining a dispersion.

To the obtained dispersion, 0.005 parts by mass of dioctyltin dilaurate as a catalyst and 30 parts by mass of silicone resin particles (Tospearl 145, manufactured by GE Toshiba Silicones, Co., Ltd.) are added, thereby obtaining a coating liquid for an undercoat layer. This coating liquid is coated onto an aluminum substrate having a diameter of 84 mm, a length of 357 mm, and a thickness of 1 mm by dip coating, followed by drying and curing at 175° C. for 40 minutes, thereby obtaining an undercoat layer having a thickness of 22 μm.

(Preparation of Charge Generating Layer)

A mixture including 15 parts by mass of hydroxy gallium phthalocyanine as a charge generating material in which the Bragg angle (2θ±0.2°) of an X-ray diffraction spectrum using X-rays having Cukα characteristics has diffraction peaks at positions of at least 7.3°, 16.0°, 24.9°, and 28.0°, 10 parts by mass of a vinyl chloride-vinyl acetate copolymer resin (VMCH, manufactured by Nippon Unicar Co., Ltd.) as a binder resin, and 200 parts by mass of n-butyl acetate is dispersed with a sand mill for 4 hours by using glass beads having a diameter of 1 mmϕ. To the obtained dispersion, 175 parts by mass of n-butyl acetate and 180 parts by mass of methyl ethyl ketone are added, followed by stirring, thereby obtaining a coating liquid for a charge generating layer. This coating liquid for a charge generating layer is coated onto the undercoat layer by dip-coating, followed by drying at room temperature (25° C.), thereby forming a charge generating layer having a film thickness of 0.2 μm.

(Preparation of Charge Transporting Layer)

30 parts by mass of N,N'-diphenyl-N,N'-bis(3-methylphenyl)-[1,1']biphenyl-4,4'-diamine, 10 parts by mass of T-651 manufactured by Takasago International Corporation, and 57 parts by mass of a bisphenol Z polycarbonate resin (viscosity average molecular weight: 50000) are added to 800 parts by mass of chlorobenzene, followed by dissolving, thereby obtaining a coating liquid for a charge transporting layer. This coating liquid for a charge transporting layer is coated onto the charge generating layer, followed by drying at 125° C. for 60 minutes, thereby forming a charge transporting layer having a film thickness of 21 μm.

(Preparation of Outermost Surface Layer)

75 parts by mass of the crosslinkable charge transport material having an aromatic group and a —$CH_2OH$ group and represented by (I-16), 20 parts by mass of the crosslinkable charge transport material having a reactive alkoxyl group and represented by (I-26), 0.5 parts by mass of 3,5-di-t-butyl-4-hydroxytoluene (BHT) as an antioxidant, 0.03 parts by mass of NACURE 2107 (manufactured by King Industries, Inc.) 0.05 parts by mass of a leveling agent BYK-302 (manufactured by BYK-Chemie Japan KK), 50 parts by mass of cyclopentanol, and 30 parts by mass of cyclopentyl methyl ether are mixed, thereby preparing a coating liquid for an outermost surface layer. This coating liquid for an outermost surface layer is coated onto the charge transporting layer by dip coating, followed by air drying at room temperature (25° C.) for 20 minutes, and then the resultant is cured by being heated at 155° C. for 30 minutes in a nitrogen atmosphere to form an outermost surface layer having a film thickness of 7 μm, thereby preparing a photoreceptor of Example 1.

Figure 5:
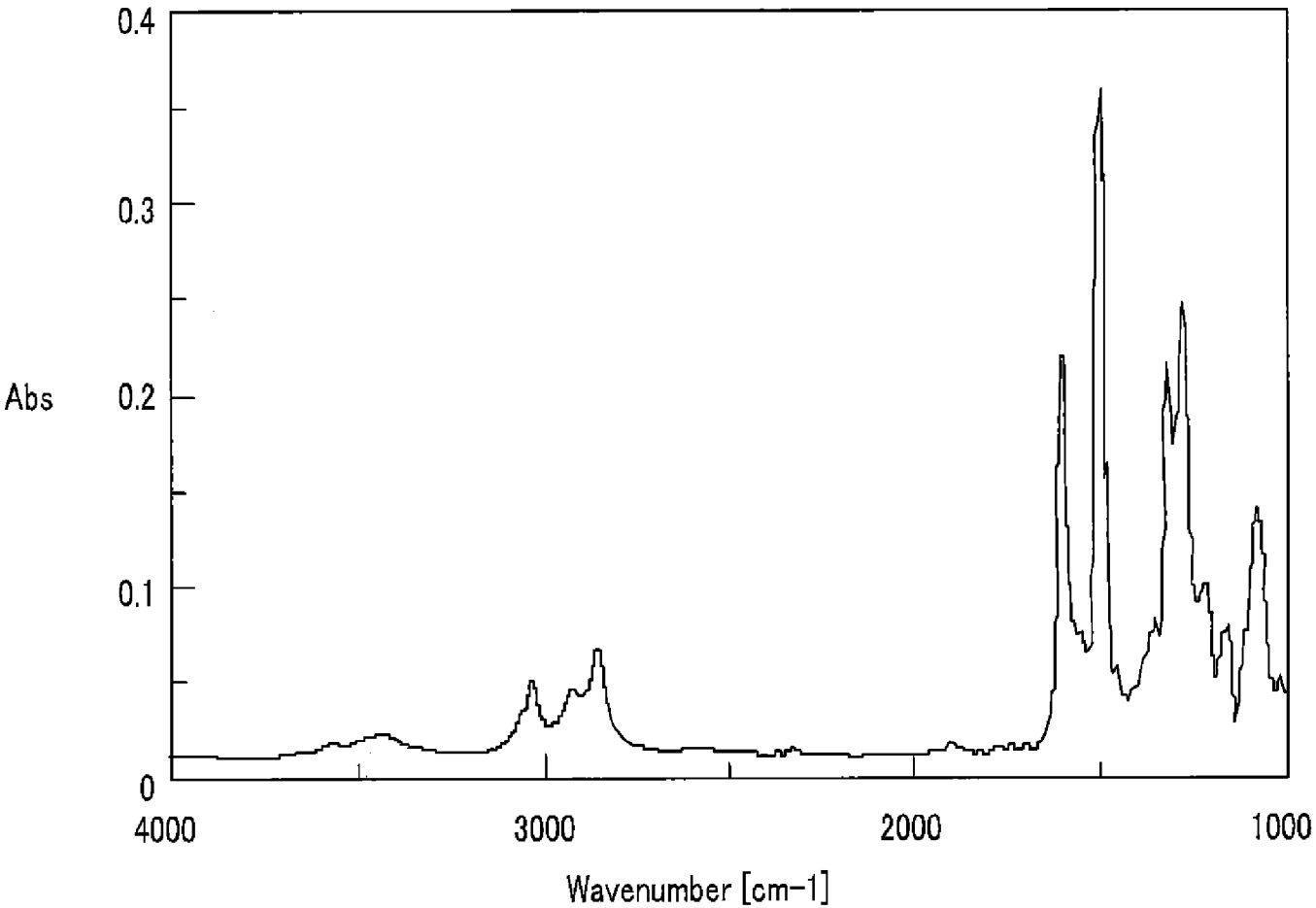
FIG. 5 is a graph showing an infrared absorption spectrum of an outermost surface layer formed in Example 1.

The infrared absorption spectrum of the surface (outermost surface layer) of this photoreceptor is measured by an ATR method by using an FT-IR-6100 manufactured by JASCO Corporation, and as a result, the ratio (Peak 2/Peak 1) between a peak area (Peak 2) of aromatic aldehyde (Ar—CHO) that has an absorption peak in a range of from 1670 $cm^{-1}$ to 1710 $cm^{-1}$ and a peak area (Peak 1) of stretching vibration of an aromatic group (—CH═CH—) that has an absorption peak in a range of from 1550 $cm^{-1}$ to 1650 $cm^{-1}$ is 0.015. The graph of the infrared absorption spectrum measured with respect to the outermost surface layer of Example 1 is shown in FIG. 5.

[Image Quality Evaluation]

The electrophotographic photoreceptor prepared in the above-described manner is mounted on a Color 1000 Press manufactured by Fuji Xerox Co., Ltd., and the following evaluation is consecutively performed in an environment of 30° C. and 85% RH.

That is, in an environment of 30° C. and 85% RH, 100000 sheets of 20% half tone images are consecutively formed for image forming tests, and an image obtained immediately after the $100000^{th}$ sheet is printed and an image obtained firstly after the electrophotographic photoreceptor has been left as it is for 24 hours in the same environment are evaluated as below.

The results are shown in Table 2.

In addition, for the image forming test, P paper (A3 size) manufactured by Fuji Xerox Co., Ltd. is used.

(Image Deletion Evaluation)

Image deletion is judged by visual observation based on the following indices.

A: Excellent

B: There is no problem while printing tests are consecutively conducted, but image deletion occurs after the electrophotographic photoreceptor has been left for 24 hours. Here, this is unproblematic since the image deletion is recovered after 10 sheets are printed.

C: There is no problem while printing tests are consecutively conducted, but image deletion occurs after the electrophotographic photoreceptor has been left for 24 hours. The image deletion is not recovered even after 10 sheets are printed.

D: Image deletion occurs even while the printing tests are consecutively conducted.

(Surface Charge Retentivity Evaluation)

The surface charge retentivity is evaluated in the following manner, and the results are shown in Table 2.

In the test for the image quality evaluation, a primary charged potential is charged to −700 V, and then 100000 sheets of images are formed for image forming tests in the same condition, thereby measuring the primary charged potential and the charged potential after the 100000-sheet formation. Based on the potential difference before and after the image forming test, the surface charge retentivity is evaluated by the following indices.

A: Potential difference of 20 V or less (charge retentivity is excellent)

B: Potential difference of greater than 20 V and equal to or lower than 40 V (though slightly poor, charge retentivity is in a controllable range)

C: Potential difference of greater than 40 V (charge retentivity is poor and not easily controlled for a practical use)

Examples 2 to 12, Example 16, Example 17, Comparative Examples 1 to 5

Photoreceptors are prepared in the same manner as described in Example 1, except that the charge transport material used and the amount thereof, the acid catalyst, and the curing temperature/time/curing condition in the Example 1 are changed according to Table 1, and the photoreceptors are evaluated Example 13

A mixed solution including 30 parts by mass of cyclopentanol and 20 parts by mass of cyclopentyl methyl ether is mixed with 10 parts by mass of PTFE particles (Lubron L-2 manufactured by DAIKIN INDUSTRIES, LTD.) and 0.05 parts by mass of a fluorine-containing graft polymer (Aron GF-300 manufactured by TOAGOSEI CO., LTD.), thereby preparing a PTFE particle dispersion by using a nanomizer dispersing machine.

A coating liquid for an outermost surface layer is prepared in the same manner as that in Example 2 so as to prepare a photoreceptor, except that 50 parts by mass of cyclopentanol is reduced to 30 parts by mass and 30 parts by mass of cyclopentyl methyl ether is reduced to 20 parts by mass, and that the PTFE particle dispersion is added in the coating liquid for an outermost surface layer of Example 2, and the photoreceptor is evaluated.

Example 14

A photoreceptor is prepared in the same manner as described in Example 1, except that 30 parts by mass of a methylated benzoguanamine resin (product name BL-60: non-volatile content of 60%, manufactured by Sanwa Chemical co., LTD.) is used instead of the crosslinkable charge transport material that is represented by (I-26) and has a reactive alkoxyl group in the preparation of the outermost surface layer of Example 1, and the photoreceptor is evaluated.

Example 15

A photoreceptor is prepared in the same manner as described in Example 1, except that the amount of the crosslinkable charge transport material that has an aromatic group and a —$CH_2OH$ group and is represented by (I-16) is changed from 75 parts by mass to 55 parts by mass, and that 20 parts by mass of methylated benzoguanamine resin (product name BL-60: non-volatile content of 60%, manufactured by Sanwa Chemical co., LTD.) is added in the preparation of the outermost surface layer of Example 1, and the photoreceptor is evaluated.

TABLE 1

| | Charge transport material 1 | Charge transport material 2 | Acid catalyst | Curing temperature/ time/ curing condition |
|---|---|---|---|---|
| Example 1 | I-16/75 parts | I-26/20 parts | NACURE 2107 | 155° C./30 minutes/nitrogen atmosphere |
| Example 2 | I-16/75 parts | I-26/23 parts | NACURE 5225 | 155° C./30 minutes/nitrogen atmosphere |
| Example 3 | I-5/80 parts | I-33/15 parts | NACURE 4167 | 145° C./30 minutes/ atmosphere |

TABLE 1-continued

| | Charge transport material 1 | Charge transport material 2 | Acid catalyst | Curing temperature/ time/ curing condition |
|---|---|---|---|---|
| Example 4 | I-8/70 parts | I-26/25 parts | NACURE 2500 | 145° C./30 minutes/ atmosphere |
| Example 5 | I-8/73 parts | I-27/20 parts | NACURE 2107 | 155° C./30 minutes/nitrogen atmosphere |
| Example 6 | I-5/82 parts | I-26/23 parts | NACURE 2107 | 155° C./30 minutes/nitrogen atmosphere |
| Example 7 | I-9/98 parts | I-27/23 parts | NACURE 2107 | 155° C./30 minutes/nitrogen atmosphere |
| Example 8 | I-9/90 parts | I-26/23 parts | NACURE 2107 | 155° C./30 minutes/nitrogen atmosphere |
| Example 9 | I-11/95 parts | I-33/15 parts | NACURE 2107 | 155° C./30 minutes/nitrogen atmosphere |
| Example 10 | I-3/97 parts | I-26/25 parts | NACURE 2107 | 155° C./30 minutes/nitrogen atmosphere |
| Example 11 | I-16/96 parts | I-27/20 parts | NACURE 2107 | 155° C./30 minutes/nitrogen atmosphere |
| Example 12 | I-19/91 parts | I-26/23 parts | NACURE 2107 | 155° C./30 minutes/nitrogen atmosphere |
| Example 13 | I-16/75 parts | I-26/23 parts | NACURE 5225 | 155° C./30 minutes/nitrogen atmosphere |
| Example 14 | I-16/75 parts | — | NACURE 2107 | 140° C./30 minutes/nitrogen atmosphere |
| Example 15 | I-16/55 parts | I-27/20 parts | NACURE 2500 | 150° C./25 minutes/nitrogen atmosphere |
| Example 16 | I-8/95 parts | I-26/5 parts | NACURE 2500 | 145° C./30 minutes/ atmosphere |
| Example 17 | I-8/50 parts | I-26/40 parts | NACURE 2500 | 145° C./40 minutes/nitrogen atmosphere |
| Comparative Example 1 | I-16/98 parts | — | NACURE 2107 | 155° C./30 minutes/ atmosphere |
| Comparative Example 2 | I-5/95 parts | — | NACURE 5225 | 155° C./30 minutes/ atmosphere |
| Comparative Example 3 | I-8/91 parts | — | NACURE 4167 | 165° C./30 minutes/ atmosphere |
| Comparative Example 4 | — | I-27/91 parts | NACURE 2500 | 165° C./30 minutes/ atmosphere |
| Comparative Example 5 | I-8/95 parts | I-26/5 parts | NACURE 2500 | 155° C./50 minutes/ atmosphere |

TABLE 2

| | Peak 2/Peak 1 | Image deletion evaluation | Charge retentivity evaluation |
|---|---|---|---|
| Example 1 | 0.015 | A | A |
| Example 2 | 0.041 | A | A |
| Example 3 | 0.035 | A | A |
| Example 4 | 0.046 | A | A |
| Example 5 | 0.022 | A | A |
| Example 6 | 0.039 | A | A |
| Example 7 | 0.016 | A | A |
| Example 8 | 0.015 | A | A |
| Example 9 | 0.03 | A | A |
| Example 10 | 0.041 | A | A |
| Example 11 | 0.028 | A | A |
| Example 12 | 0.01 | A | A |
| Example 13 | 0.045 | A | B |
| Example 14 | 0.03 | B | B |
| Example 15 | 0.035 | B | B |
| Example 16 | 0.045 | B | B |
| Example 17 | 0.048 | B | B |
| Comparative Example 1 | 0.055 | C | C |
| Comparative Example 2 | 0.06 | C | C |
| Comparative Example 3 | 0.11 | D | C |
| Comparative Example 4 | 0.082 | D | C |
| Comparative Example 5 | 0.12 | D | C |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate; and a photosensitive layer on the conductive substrate, wherein:

a layer having an outermost surface of the photoreceptor contains a copolymer obtained by polymerizing a crosslinkable charge transport material having an aromatic group and a —$CH_2OH$ group with a crosslinkable charge transport material having a reactive alkoxyl group;

the crosslinkable charge transport material having an aromatic group and a —$CH_2OH$ group is a compound represented by the following Formula (I-1):

$$F^1—(L^1—OH)_n \quad (I\text{-}1),$$

where:

$F^1$ represents an organic group derived from a compound having a hole transport property and an aromatic group, $L^1$ represents a linear or branched alkylene group having from 1 to 5 carbon atoms, and n represents an integer of from 1 to 4;

the crosslinkable charge transport material having the reactive alkoxyl group is a compound represented by the following Formula (I-2):

$$F^2—(L^2—OR)_m \quad (I\text{-}2)$$

where:

$F^2$ represents an organic group derived from a compound having a hole transport property, $L^2$ represents a linear or branched alkylene grow having from 1 to 5 carbon atoms, R represents an alkyl group, and m represents an integer of from 1 to 4; and the layer having the outermost surface satisfies the following Formula (1):

$$(\text{Peak 2})/(\text{Peak 1}) \leq 0.05 \quad (1),$$

where:

Peak 1 represents a peak area of an absorption peak (from about 1550 $cm^{-1}$ to about 1650 $cm^{-1}$) of stretching vibration of an aromatic group, which is obtained when an infrared absorption spectrum of the layer having the outermost surface is measured, and Peak 2 represents a peak area of an absorption peak (from about 1670 $cm^{-1}$ to about 1710 $cm^{-1}$) of aromatic aldehyde, which is obtained when the infrared absorption spectrum of the layer having the outermost surface is measured.

2. The electrophotographic photoreceptor according to claim 1, wherein the layer having the outermost surface layer satisfies the following Formula (2):

$$(\text{Peak 2})/(\text{Peak 1}) \leq 0.03 \quad (2).$$

3. The electrophotographic photoreceptor according to claim 1, wherein the compound represented by Formula (I-1) is a compound having a structure represented by the following Formula (II-1):

(II)-1

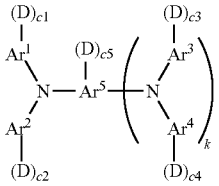

where:

$Ar^1$ to $Ar^4$ may be the same as or different from each other, and each independently represents a substituted or unsubstituted aryl group;

$Ar^5$ represents a substituted or unsubstituted aryl group or a substituted or unsubstituted arylene group;

D represents —($L^1$—OH);

each c1 to c5 independently represents 0 or 1;

k represents 0 or 1;

the total number of D is from 1 to 4; and $L^1$ represents a linear or branched alkylene group having from 1 to 5 carbon atoms.

4. The electrophotographic photoreceptor according to claim 1, wherein the compound represented by Formula (I-2) is a compound having a structure represented by the following Formula (II-2):

(II)-2

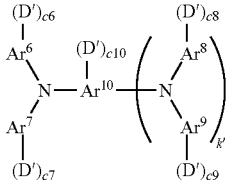

where:

$Ar^6$ to $Ar^9$ may be the same as or different from each other, and each independently represents a substituted or unsubstituted aryl group;

$Ar^{10}$ represents a substituted or unsubstituted aryl group or a substituted or unsubstituted arylene group;

D' represents —($L^2$—OR);

each c6 to c10 independently represents 0 or 1;

k' represents 0 or 1;

the total number of D' is from 1 to 4;

$L^2$ independently represents a linear or branched alkylene group having from 1 to 5 carbon atoms; and R represents an alkyl group.

5. The electrophotographic photoreceptor according to claim 1, wherein in Formula (I-1), the organic group derived from a compound having a hole transport property represented by $F^1$ is an organic group having a skeleton selected from a triphenylamine skeleton, an N,N,N',N'-tetraphenyl benzidine skeleton, a stilbene skeleton, or a hydrazone skeleton.

6. The electrophotographic photoreceptor according to claim 1, wherein in Formula (I-2), the organic group derived from a compound having a hole transport property represented by $F^2$ is an organic group having a skeleton selected from a triphenylamine skeleton, an N,N,N',N'-tetraphenyl benzidine skeleton, a stilbene skeleton, or a hydrazone skeleton.

7. The electrophotographic photoreceptor according to claim 1, wherein the copolymer is cured in nitrogen at a temperature of from 120° C. to 160° C. for 20 to 40 minutes.

8. An image forming apparatus comprising:

the electrophotographic photoreceptor according to claim 1;

a charging device that charges the electrophotographic photoreceptor;

an exposure device that exposes the charged electrophotographic photoreceptor to form an electrostatic latent image;

a developing device that develops the electrostatic latent image with a toner to form a toner image; and a transfer device that transfers the toner image from the electrophotographic photoreceptor to a recording medium.

9. A process cartridge comprising:

the electrophotographic photoreceptor according to claim 1; and at least one device selected from a group consisting of a charging device that charges the electrophotographic photoreceptor, an exposure device that exposes the charged electrophotographic photoreceptor to form an electrostatic latent image, a developing device that develops the electrostatic latent image with a toner to forms a toner image, and a cleaning device that removes a residual toner on the surface of the electrophotographic photoreceptor.

* * * * *